United States Patent [19]

Kurtz, Jr.

[11] Patent Number: 5,036,638

[45] Date of Patent: Aug. 6, 1991

[54] SERVICE BUILDING AND THE STRUCTURAL COMPONENTS THEREOF

[75] Inventor: Robert L. Kurtz, Jr., Barberton, Ohio

[73] Assignee: Air Enterprises, Inc., Akron, Ohio

[21] Appl. No.: 370,733

[22] Filed: Jun. 23, 1989

[51] Int. Cl.[5] ..... E04H 1/00

[52] U.S. Cl. ..... 52/284; 52/264; 52/265; 52/406; 52/802; 52/803; 52/821; 52/79.1

[58] Field of Search ..... 52/79.1, 264–265, 52/406, 821–823, 802–805, 284

[56] References Cited

U.S. PATENT DOCUMENTS

| | | | |
|---|---|---|---|
| 3,004,877 | 10/1961 | Simms et al. | 52/805 X |
| 3,310,926 | 3/1967 | Brandreth et al. | 52/582 |
| 3,420,029 | 1/1969 | Martin | 52/804 X |
| 3,540,116 | 11/1970 | Brahos et al. | 52/805 X |
| 4,107,892 | 8/1978 | Bellem | 52/802 |
| 4,118,083 | 10/1978 | Lackey et al. | 52/822 X |
| 4,267,679 | 5/1981 | Thompson | 52/802 |
| 4,393,634 | 7/1983 | McDermott et al. | 52/309.1 |
| 4,470,227 | 12/1984 | Bigelow, Jr. et al. | 52/79.1 |
| 4,754,587 | 7/1988 | Glaser | 52/282 |
| 4,843,788 | 7/1989 | Gavin et al. | 52/79.1 X |
| 4,931,340 | 6/1990 | Baba et al. | 52/806 X |

FOREIGN PATENT DOCUMENTS

| | | | |
|---|---|---|---|
| 1429631 | 3/1965 | France | 52/265 |
| 247649 | 10/1989 | Japan | 52/578 |

*Primary Examiner*—David A. Scherbel
*Assistant Examiner*—Deborah McGann Ripley
*Attorney, Agent, or Firm*—Renner, Kenner, Greive, Bobak, Taylor & Weber

[57] ABSTRACT

A service building (10) having a base assembly (20) formed with a perimeter support portion (21) and a floor portion (22). The perimeter support portion (21) utilizes weight bearing side rails (23) with one or more transverse, weight supporting beam means (35) extending between at least one pair of opposite side rails (23). Decking sheets (30), insulating mats (44) and sump pans (48) are supported from the side rails (23) and beam means (35). Wall panel assemblies (60) are secured to the perimeter support portion (21) by sill connector assemblies (78). Post assemblies (105, 135 and 165) between the wall panel assemblies (60) secure adjacent wall panel assemblies together. A roof (not shown) may be secured to the service building (10) using connector assemblies substantially identical with the post assemblies. The walls of the service building (10) may include doors (15) which are formed from door panel assemblies (213) surrounded by a perimeter mullion assembly (210) to be mounted within a door jamb assembly (215). The walls of the service building (10) may also include one or more apertures (16) which may be circumscribed by several framing members (266, 268 or 269) which may be secured to the wall panel assemblies (60) and/or the post assemblies (105, 135 or 165).

51 Claims, 14 Drawing Sheets

SERVICE BUILDING AND THE STRUCTURAL COMPONENTS THEREOF

TECHNICAL FIELD

The present invention relates generally to building structures. More particularly, the present invention relates to structural components for fabricating service buildings. Specifically, the present invention relates to panel assemblies, vertically oriented post assemblies for maintaining the panel assemblies in proper position within the structure of a service building and a base assembly for supporting a floor assembly, the post assemblies and the panel assemblies.

BACKGROUND OF THE INVENTION

Service buildings are structures for enclosing air handling units such as fans and air conditioners, and service buildings are normally erected on, or in proximity to, a main building, such as a factory, in which the air is to be used or distributed. Service buildings are generally located on the roof of the main building or at ground level adjacent the main building, and such structures are normally constructed on site by first erecting a frame and then securing the walls and roof to the frame.

Although such structures are often made from standard components, such as 4×8 foot sheets of plywood, composite board, or other sheet-like panels, it is, nevertheless, generally necessary to cut some components to size on site. Accordingly, hammers, saws, and other construction tools, must be transported to the construction site. It should also be appreciated that when one utilizes components of standard, off-the-shelf dimensions, and when on-site fitting is to be minimized, the design of the resulting structure is severely limited.

The prior art construction and use of composite wall panels is perhaps best exemplified by the disclosure of U.S. Pat. No. 3,310,926. The frame members for use with such wall panels are normally extruded from a metallic substance such as aluminum to provide a light weight, yet strong, frame that will impart structural integrity to the resulting panel. The facing, or skin, of such panels is also a preferably light weight material, such as a plastic sheeting material or a thin gauge metallic substance (in this situation, as well, aluminum may be satisfactorily employed). The frame members have historically been fastened together by suitable means such as rivets, bolts or other mechanical fasteners, and the facing materials have historically been secured to the frame members by an adhesive. The interior, or core, of each panel is usually filled with thermal, as well as sound, insulating materials. Typical core filler materials are polystyrene, or other plastic foams, fiberglass layers and even phenolic impregnated paper honeycomb sheets. In fact, virtually any type of core filler may be employed, so long as it provides the desired insulating qualities. Such panels may be sufficiently rigid to provide structural integrity to the walls constructed therefrom, and yet they are sufficiently light in weight that they can be manually manipulated with relative ease to facilitate the assembly and erection of walls in a building structure.

As is well known to the prior art, such panels may be erected upwardly of sill members supported from a foundation, roof or other relatively flat surface with considerable facility. Such sill members typically extend upwardly a sufficient extent so as to lie above the level of any water that would normally be expected to collect in proximity thereto. Doors, windows or other openings may be included, as desired or required. Even though such panels are frequently employed to erect structures that are preferably windowless, the panels are often required to be provided with openings to accommodate filters, duct work, louvers or the like. Such panels are sufficiently air tight that they preclude the circulation of air therethrough, and the core material can be selected to prevent excess thermal conduction or radiation through the panels themselves.

The prior art arrangements generally required some skill to cut and erect at least the framing members, on site, and such arrangements are, therefore, more labor intensive, and thus more expensive, than desirable.

SUMMARY OF THE INVENTION

It is, therefore, a primary object of the present invention to provide improved structural components from which service buildings can be conveniently and efficiently fabricated.

It is another object of the present invention to provide improved structural components for fabricating service buildings, as above, wherein the structural components are in the nature of a pair of sheet metal skin members formed with a central recess and a peripheral connector flange and wherein the skin members may be opposed such that the central recess formed within each of the opposed skin members will form a central cavity which may be filled with an insulating material and the peripheral connector flanges of the opposed skin members may be conjoined to comprise a wall panel assembly.

It is a further object of the present invention to provide improved structural components for fabricating service buildings, as above, wherein the wall panel assemblies may be secured in an upright wall arrangement by a sill connector assembly and one or more post assemblies.

It is yet another object of the present invention to provide improved structural components for fabricating service buildings, as above, wherein the post assemblies incorporate supporting mullions which operatively engage the perimeter flanges of the panel assemblies and receive fastener means which secure the peripheral connector flanges of the panel assemblies to the supporting mullions of the post assemblies.

It is an even further object of the present invention to provide improved structural components for fabricating service buildings, as above, wherein the structural components are in the nature of a door construction that may be operatively received within a unique jamb assembly.

It is a still further object of the present invention to provide improved structural components for fabricating service buildings, as above, wherein the structural components are in the nature of framing components which may be utilized to define apertures which penetrate the wall arrangement.

These and other objects of the invention, as well as the advantages thereof over existing and prior art forms, which will be apparent in view of the following detailed specification, are accomplished by means hereinafter described and claimed.

In general, a building embodying the concepts of the present invention is used as a utility, or service, building to house, for example, air handling equipment such as fans or air cooling apparatus. These buildings are assembled at the site of a larger structure. They may be erected on the roof of the larger structure or on a concrete slab adjacent to, or within, the larger structure. Regardless of the location of the service building, the structural components will have the same construction. The dimensions of the wall panel assemblies can, if necessary, be customized during manufacture of the panel assemblies for utilization with standard structural components incorporating the concepts of the present invention to provide a service building that is capable of most advantageously to housing the particular equipment to be received therein.

Service buildings embodying the concepts of the present invention are erected on a base assembly that incorporates a perimeter support portion which defines the locus for the outer walls of the service building incorporating the concepts of the present invention. The perimeter support portion surrounds a central floor portion. A plurality of laterally spaced beam means span between, and are supported from, the perimeter support portion. The central floor portion is dependingly supported from the beam means and the perimeter support portion.

A plurality of wall panel assemblies extend upwardly from the perimeter support portion to comprise the walls of the building structure. Each wall panel assembly is fabricated from skin members. In turn, each skin member has a central recess circumscribed by side walls which terminate in a peripheral connector flange. The skin members are conjoined along the peripheral flange, and the central recesses of the opposed skin members provide a cavity within which an insulating material may be received.

A sill connector assembly secures the wall panel assembly to the perimeter support portion, and a plurality of post assemblies may rest upon, and extend upwardly from, at least the perimeter support portion to secure successive wall panel assemblies into an upright wall arrangement.

In addition, unique door and jamb assemblies may be employed to permit access to a building structure embodying the concepts of the present invention. And, apertures may be provided through the upright wall arrangement. Such apertures may be structurally enhanced, as required, by unique framing components.

A roof may be comprised of the same basic panel assemblies as the panel assemblies from which the upright wall arrangements are fabricated. The panel assemblies forming the roof may be joined to the walls, and to each other, with mullions in a manner similar to the manner in which the panel assemblies are joined to form intersecting corners.

The finished service building will be insulated from the surrounding environment so that the noise generated within the service building will not be transmitted to the outside and the interior temperature of the service building will not be affected by the ambient environment, or vice versa.

The overall size and shape of the finished service building will depend upon the particular purpose of the building and the amount and type of equipment to be housed therein. The building, regardless of size, can be constructed at the manufacturer's factory prior to shipment to the customer. This insures that the finished product will be correct and obviates the necessity for on-site sizing of components. In some instances the entire service building can be shipped as assembled to the final destination. In other situations, the building will be partially, or completely, disassembled for shipment to the customer. Only the base assembly, which is preferably welded together, need normally remain intact.

One exemplary embodiment of a service building fabricated from components incorporating the objects of the present invention is deemed sufficient to effect a full disclosure of the subject invention and is shown, in part, by way of example in the accompanying drawings and the depicted portions are described in detail without attempting to show all of the various forms and modifications in which the invention might be embodied; the invention being measured by the appended claims and not by the details of the specification.

BRIEF DESCRIPTION OF THE DRAWINGS

FIG. 24 is a schematic, horizontal, cross sectional view, partly in plan, which also depicts the interconnection to which FIG. 23 is directed;

DESCRIPTION OF AN EXEMPLARY EMBODIMENT

Figure 1:
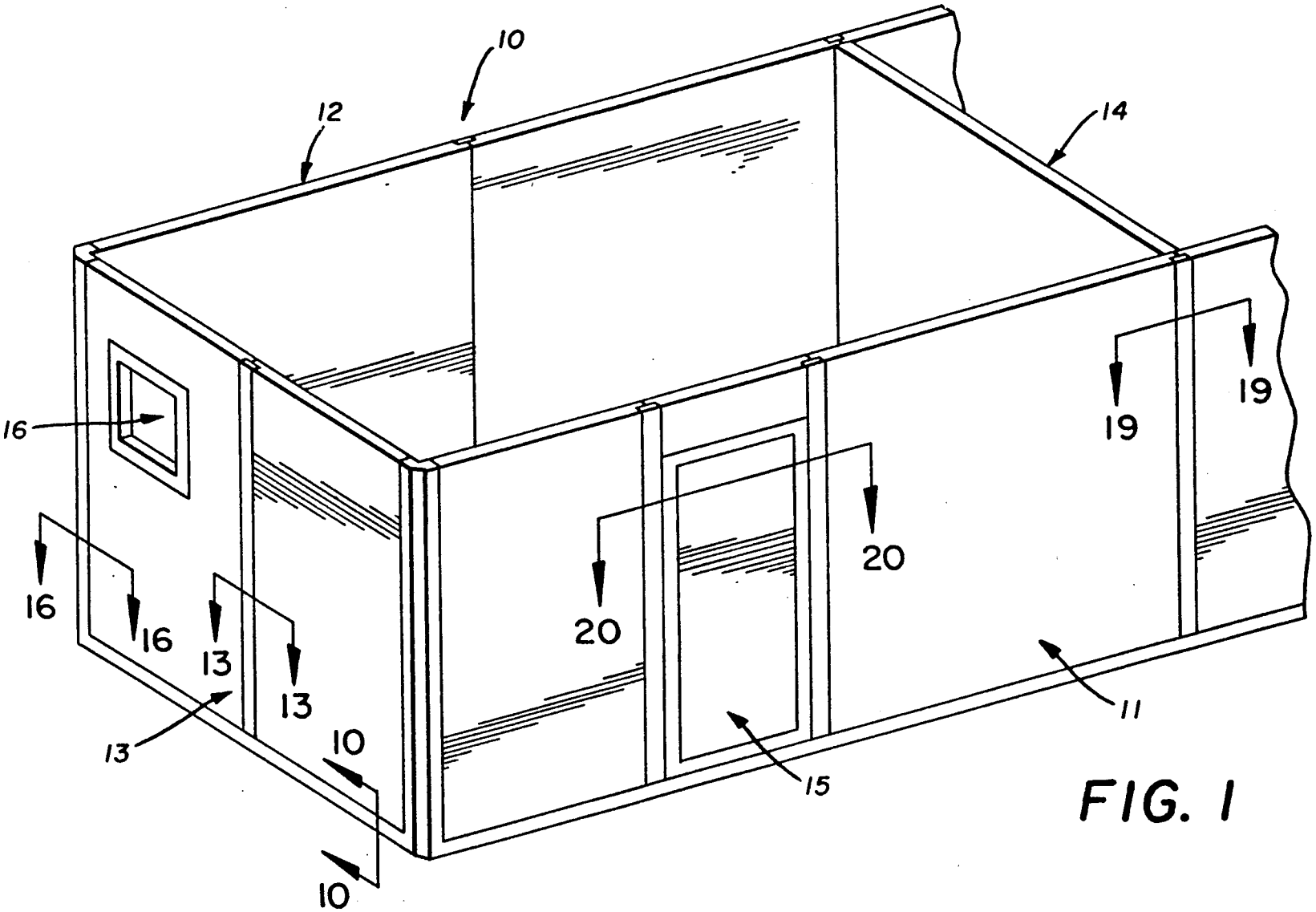
FIG. 1 is a schematic perspective of a portion of a service building structure embodying the concepts of the present invention, but with the roof removed for purposes of clarity.

A portion of one representative form of a service building embodying the concepts of the present invention is depicted in FIG. 1 and is designated generally by the numeral 10. As shown, the service building 10 may have first and second side walls 11 and 12, respectively, at least one end wall 13, and perhaps one or more, transverse, interior walls 14. The building 10 will, of course, generally be provided with another end wall (not shown), and the building may have one or more additional transverse, interior walls, but they are not depicted in order to simplify the disclosure. Once the concept hereinafter described is understood it would be well within the ability of one skilled in the art to reduce, or expand, the number of walls, as desired.

In addition, a roof (also not shown) may be provided for the building 10, and the roof structure may comprise the same construction as that of the walls. The service building 10 has at least one door 15 for ingress and egress, a representative example of which is depicted in wall 11, and any number of access openings 16, an example of which is represented as being provided through the end wall 13.

Figure 2:
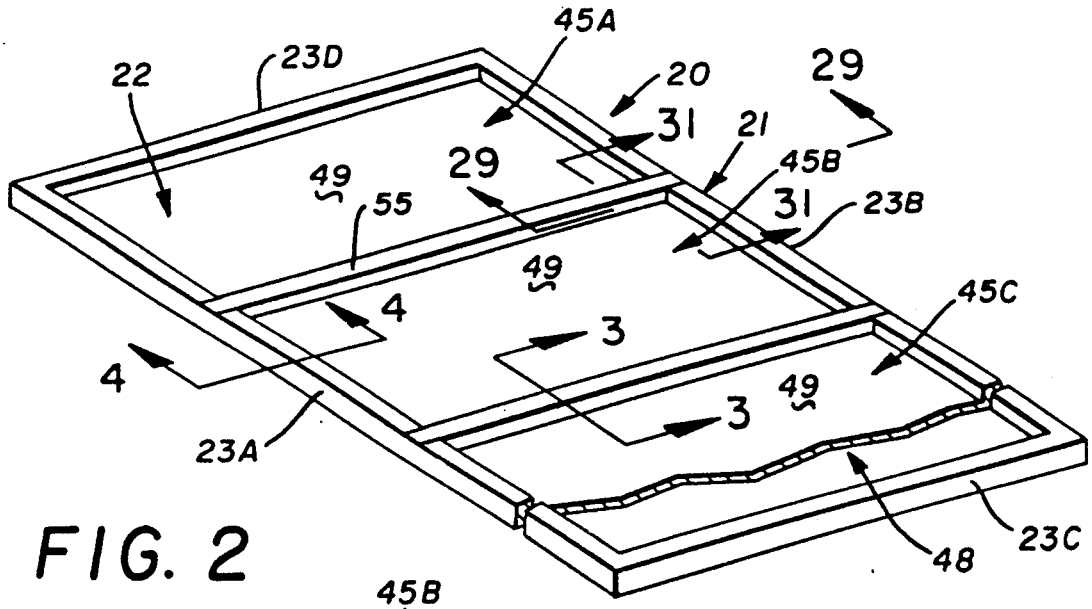
FIG. 2 is a schematic perspective of a typical foundation substructure upon which a service building structure of the type depicted in FIG. 1 may be erected.
Figure 3:
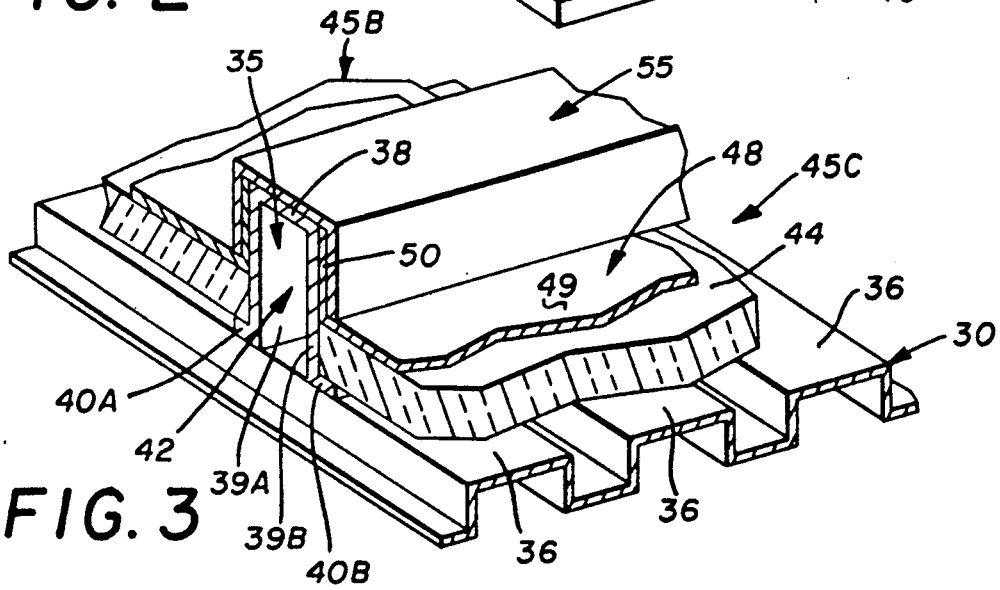
FIG. 3 is an enlarged, cross sectional perspective taken substantially along line 3—3 of FIG. 2 to depict the various components of the base assembly relative to one of the laterally spaced, transverse beam members incorporated therein.
Figure 4:
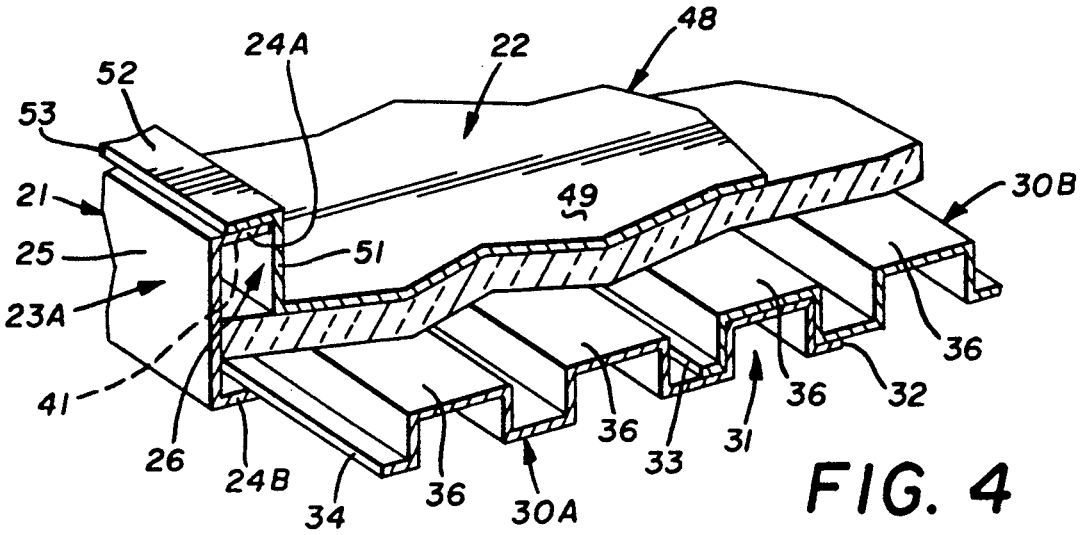
FIG. 4 is also an enlarged, cross sectional perspective taken substantially along line 4—4 of FIG. 2 to depict the various components of the base assembly as they cooperatively interact with a framing member of the perimeter support portion.

The service building 10 preferably includes a base assembly 20, the overall configuration of which is best represented in FIG. 2, and the structural details of which are best represented in FIGS. 3 and 4. With particular reference to FIGS. 2 and 4, the base assembly 20 has a perimeter support portion 21 that surrounds a central floor portion 22. The perimeter support portion 21 is comprised of a plurality of side rails, or perimeter channels, 23 which may be welded together to form the outer, perimeter of the overall base assembly 20. The side rails 23 may have a C-shaped cross sectional configuration with upper and lower, substantially parallel, flanges, or ledges, 24A and 24B, respectively, which extend substantially perpendicularly from the web portion 25 of each rail 23. The cavity 26, which extends vertically between the upper and lower ledges 24A and 24B of the side rails 23, receives the corrugated decking sheets 30 that form the lowermost level of the central floor portion 22 in the base assembly 20.

In the detailed description which follows, a particular structural member, component or arrangement may be employed at more than one location. When referring generally to that type of structural member, component or arrangement a common numerical designation shall be employed. However, when one of the structural members, components or arrangements so designated is to be individually identified, or referenced, it shall be designated by virtue of a letter suffix employed in combination with the numerical designation employed for general identification of that structural member, component or arrangement. Thus, there are at least two corrugated decking sheets which are generally identified by the numeral 30, but the specific, individual decking sheets are, therefore, identified as 30A and 30B, etc. in the specification and on the drawings. This same suffix convention shall be employed throughout the specification.

As seen in FIG. 4, the adjacent portions of decking sheets 30A and 30B overlap, as designated generally at 31. Specifically, one edge 32 of decking sheet 30A is overlapped by decking sheet 30B and may be secured to the contiguously juxtaposed portion of the sheet 30B by a plurality of tack welds provided at a plurality of spaced locations along the edge 32. Similarly, that edge 33 of decking sheet 30B which overlaps decking sheet 30A may be secured thereto, also as by tack welding, at a plurality of spaced locations along the edge 33. The opposite edge 34 of the decking sheet 30A may be secured to the lower ledge 24B, again by a plurality of tack welds located at a plurality of spaced intervals along the edge 34. The corrugated decking sheets 30 are thus secured not only to each other but also to the side rails 23 of the perimeter support portion 21 in order to provide structural integrity to the base assembly 20.

As most clearly depicted in FIG. 3, a plurality of laterally spaced, open ended, box-beams span between opposed side rails 23A and 23B. The box-beams may also have one side open, as hereinafter more fully explained, to provide a hat-shaped cross section. It should be understood that the particular cross section is not critical. The hat shaped configuration is an exemplary arrangement. The beam could, for example, also be a C-section. In any event, the aforesaid beam means will hereinafter be designated as the hat supports 35. The hat supports 35 overlie, and rest upon, the upwardly directed land surfaces 36 of the decking sheets 30. Each hat support 35 has an upper web wall 38 and a pair of laterally spaced downwardly depending, substantially parallel legs 39A and 39B. A foot or flange 40 extends perpendicularly outwardly from the lower end of each leg 39. The feet 40A and 40B, which extend from the respective legs 39A and 39B, engage, and are secured to, the land surfaces 36 of the decking sheets 30, as by welding at a plurality of successively spaced locations along the length of each hat support 35. The upper web wall 38 of each hat support 35 preferably abuts the opposed, downwardly facing, surface 41 of the upper ledge 24A. The hat supports 35 thus span between, and are supported from, the side rails 23A and 23B of the perimeter support portion 21 which extends along a locus which defines the opposed, and spacially separated, side walls 11 and 12 of the building structure 10. So disposed, the several hat supports 35 will lie parallel to the side rails 23C and 23D which are located at the ends of the base assembly 20, if the service building 10 is rectilinear. The hollow interior 42 of each hat support 35 may be filled with insulation (not shown), if desired. The number and spacing of the hat supports 35 is determined by the weight, and location, of the equipment to be supported within the service building 10.

An insulating mat 44 is preferably received within each quadrilateral bay 45 of the base assembly 20. The four sides of each bay 45 comprise appropriate lengths of the perimeter support portion 21 and the laterally spaced hat supports 35 which intersect the perimeter support portion 21. Each insulating mat 44 is preferably cut to fit within a bay 45 and to rest upon the land surfaces 36 of the decking sheets 30. The perimeter of the mat 44 may be disposed in abutting relation with successive, transverse hat supports 35 and the web portion 25 of the side rails 23 which define the bay 45 within which the mat 44 is received. These mats 44 may be made of fiberglass to provide sound and heat insulation between the inside of the service building 10 and the surrounding environment. The offal which remains after the mats 44 are trimmed to fit within the bays 45 may be inserted within the hollow interior 42 of the hat supports 35 and/or within the cavity 26 of the side rails 23.

A pan 48 provides a sump liner for each bay 45. The substantially planar body portion 49 of the pan 48 is placed on top of the mat 44 which is disposed within the bay 45. Each pan 48 has a first pair of opposed, upturned walls 50 (FIG. 3) which abut the leg portions 39 of the hat supports 35 that define the bay 45 within which the pan 48 is received. Each pan 48 also has a second pair of opposed, upturned walls 51 (FIG. 4) which terminate in outwardly directed flanges 52 that engagingly overlie the upper ledges 24A of the side rails 23 which define opposed boundaries of the bay 45 within which the pan 48 is received. The first pair of walls 50 may be secured, as by tack welding, to the adjacent leg 39 of the hat support 35. The outer edge 53 of the flange 52 on each of the second pair of walls 51 is preferably welded continuously along the engagement of that edge 53 with the upper ledge 24A of the side rail 23. The pans 48 serve as liquid retaining sumps and may be fabricated from materials that are appropriate not only to the strength required to support the machinery located within the service building 10 but also to the environment within which the pan 48 is employed. For example, if the pan will be exposed to a liquid that is corrosive, a corrosion resistant material, or coating, can be utilized. The pan 48 in each bay 45A, 45B, etc. can, therefore, be fabricated from a different material.

To complete the base assembly 20, a cap 55 (FIG. 3) is placed over each hat support 35 and the adjacent first pair of walls 50 of the pans 48. The method of attachment of the cap 55 is not critical. In fact, it is not necessary for the cap 55 to be firmly attached to the hat support 35. However, the configuration of the cap 55 is such that it can add to the beam strength of the hat support 35 so that, if desired, the cap 55 may be welded, or otherwise bonded, to the hat support 35.

With each transverse hat support 35 being firmly secured to the upper ledge 24A of the side rails 23, and with the pans 48 being firmly secured to both the hat supports 35 and the side rails 23, the weight of the equipment which is located within the service building 10 will be supported by the structural integrity of the hat supports 35 and the side rails 23 and not merely by the decking 30 and the insulating mats 44. This will prevent the mats 44 from being overly compressed and thereby adversely effecting the insulation properties thereof. Compression of the insulation material would remove much of the air space in the mats, and the insulation value of air space in such materials is well known. As such, the aforesaid structural configuration of the base assembly 20 will reduce the cost of the insulation material inasmuch as less insulating material is needed if the mats 44 are not compressed.

Figure 7:
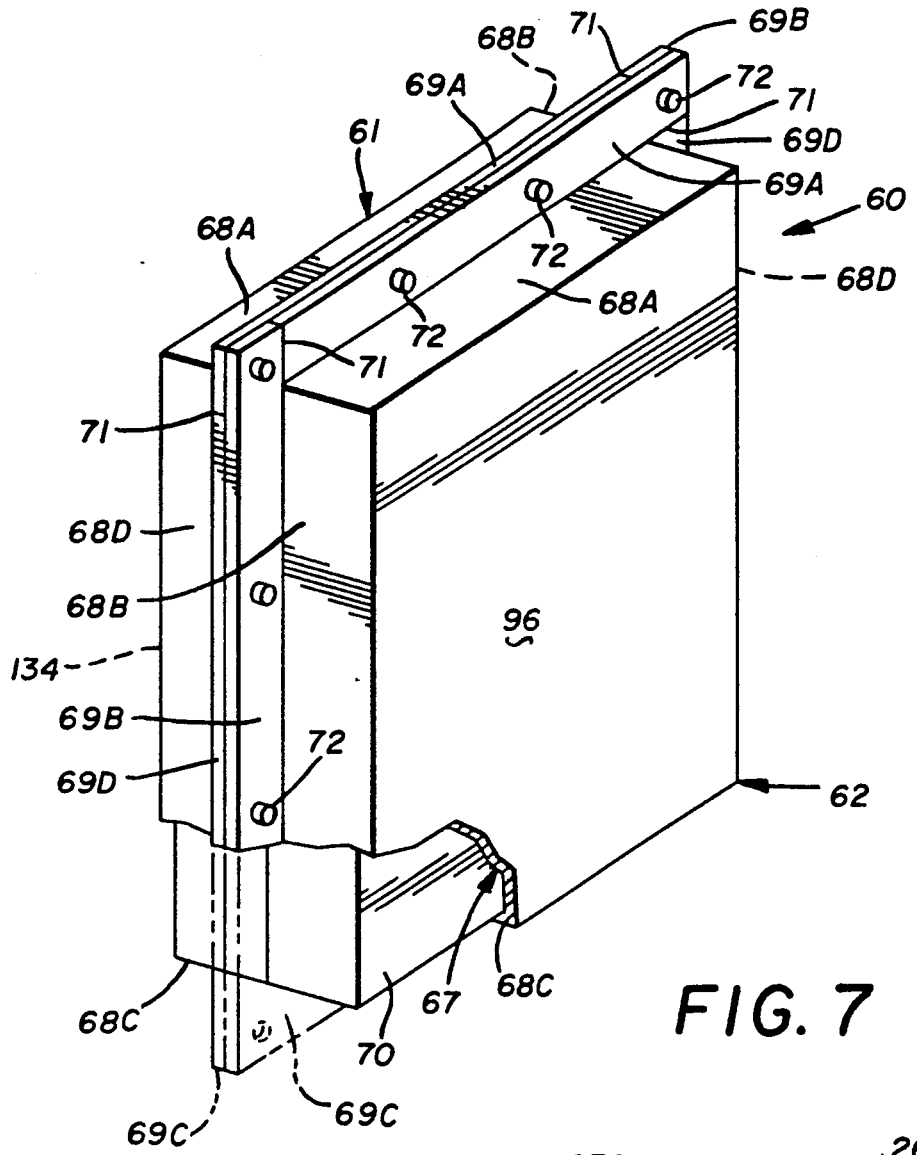
FIG. 7 is an elevational perspective of a typical wall panel assembly constructed from an opposed pair of structural skin members formed from metallic sheets of the type depicted in FIG. 5 and 6 and joined along the peripheral connector flanges.

The walls 11, 12, 13 and 14 are constructed from panel assemblies 60, as depicted in FIG. 7. The panel assemblies 60 are secured to horizontally and vertically oriented supports, as will be hereinafter more fully described.

Figure 5:
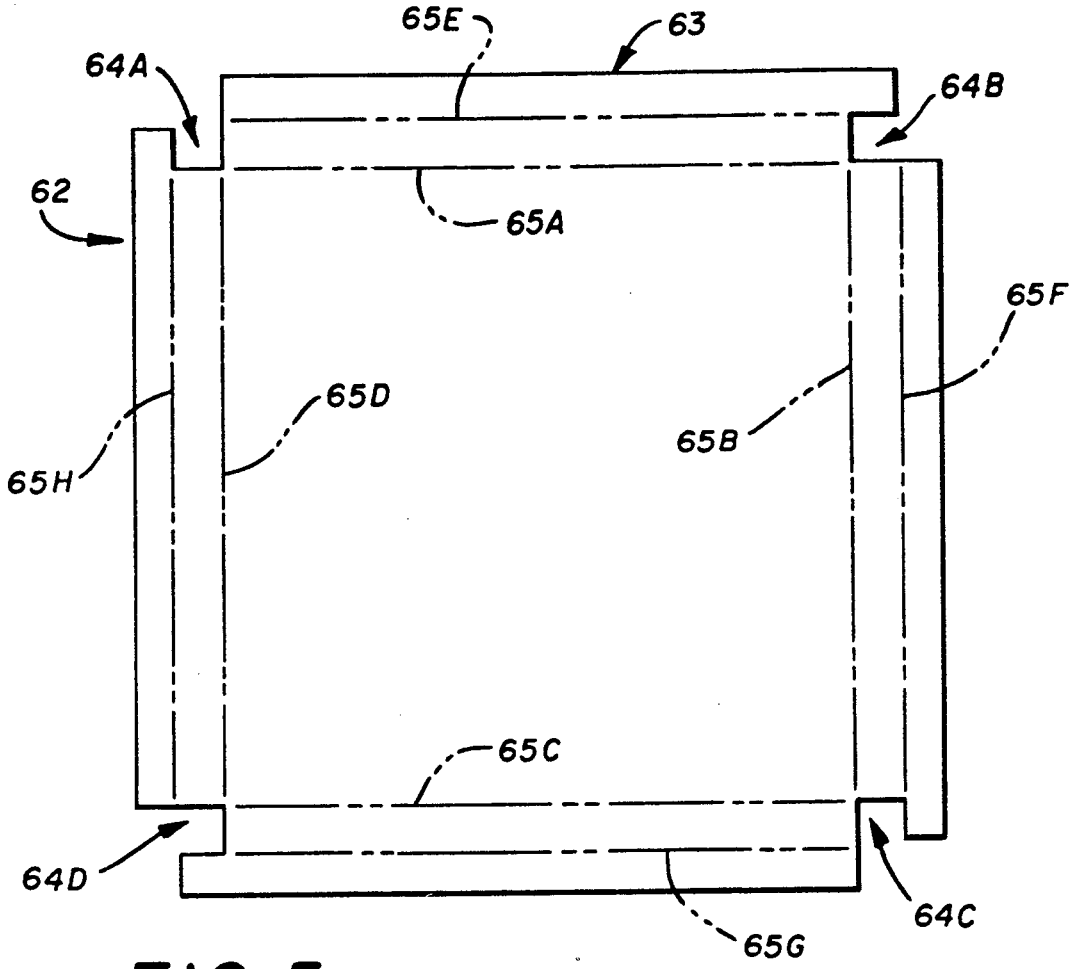
FIG. 5 is a plan view of a metallic sheet which can be fabricated into a structural skin member of a typical panel assembly utilized in a service building embodying the concepts of the present invention, the perimeter of the metallic sheet having been configured to permit formation of the desired structural arrangement for each of the corners of the structural skin member.
Figure 6:
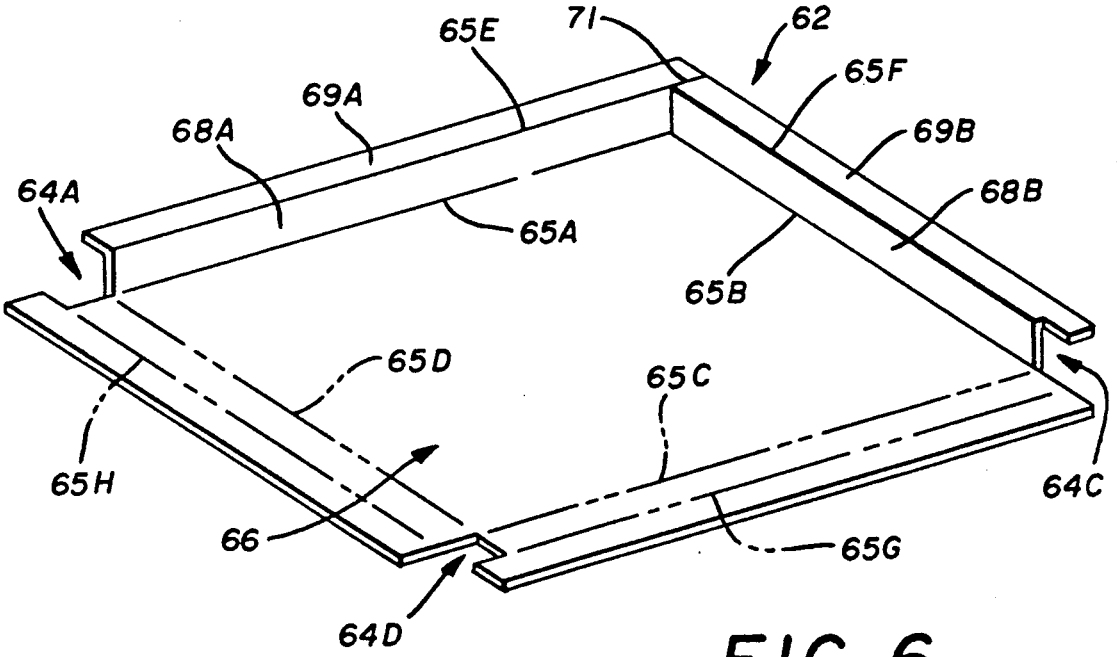
FIG. 6 is a perspective view of the metallic sheet depicted in FIG. 5 with two borders thereof having been folded to form two edge walls and the peripheral connector flange which extends outwardly therefrom, the two edges intersecting at a common corner.

Each panel assembly 60 may be constructed from two, opposed skin members 61 and 62. FIGS. 5 and 6 depict a skin member in various stages of completion. It should be understood that the structure of skin member 61 is identical to that of skin member 62. Accordingly, one may consider that FIGS. 5 and 6 depict, for example, the skin member 62, and skin member 62 is formed from a flat metal sheet 63 which, as represented in FIG. 5, is stamped to remove material and form a cut-out 64 at each corner of the sheet 63. The cut-outs 64A–64D at each corner are identical. The sheets 63 may be stamped simultaneously, or individually, to form the cut-outs 64A–64D.

The metal sheet 63 may, if desired, be scored, marked or simply identified at a plurality of locations to designate fold lines 65. The metal sheet 63 is then placed in a metal break machine and sequentially formed along each fold line 65A–65H. Bending the sheets 63 along fold lines 65A–65D forms a central recess 66 having four side walls 68A–68D, and bending the sheet 63 along fold lines 65E–65H forms the peripheral or perimeter flange 69. FIG. 6 represents the sheet after it has been folded along score lines 65A, 65B, 65E and 65F to form the side walls 68A and 68B of the central recess 66 and the associated lengths 69A and 69B of the peripheral flange 69. A suitable insulating material 70 (FIG. 7) may be secured within the central recess 66 of each skin member 61 and 62 by a suitable adhesive prior to joining the opposed skin members 61 and 62. To form a panel assembly 60 the opposed skin members 61 and 62 are disposed with the peripheral flanges 69 on each skin member 61 and 62 in abutting relation, as seen in FIG. 7.

By forming the peripheral flange 69 in the manner described, a split line 71 will result at each intersection of the perimeter flange lengths 69A–69D. However, the configuration of each cut-out 64A–64B assures that when the skin members 61 and 62 are joined—and no matter which flange length 69 on skin member 61 is opposed to which flange length 69 on skin member 62—the split lines 71 in the opposed skin members 61 and 62 at each corner will not be aligned, but will rather be disposed at right angles, as represented in FIG. 7. That disposition of the split lines 71 guarantees that the structural integrity of the corner will not be adversely affected by the location of the split lines 71.

The joinder of the peripheral flanges 69 on the opposed skin members 61 and 62 may be accomplished by staking or welding. Because of its simplicity, rapidity and reliability, staking is the preferred form of joining the abutting peripheral flanges 69 on the opposingly juxtaposed skin members 61 and 62. The staking operation results in a plurality of protuberances, or bulges, 72 on the peripheral flange 69 of one skin member 62 and a corresponding depression, or divot, (not shown) in the peripheral flange 69 of the opposed skin member 61 opposite each protuberance 72. A gasket, or seal, 74 is bonded to that peripheral flange 69 which is opposite the protuberances 72.

The opposed, central recesses 66 in the skin members 61 and 62 combine, when the skin members 61 and 62 are conjoined, to form a central cavity 67 within the wall panel assemblies 60, and the side walls 68 form the outer perimeter of the central cavity 67. As will hereinafter become apparent, these side walls 68 will be supported by, or otherwise abut, the hereinafter described horizontally and vertically oriented supporting structures.

Figure 10:
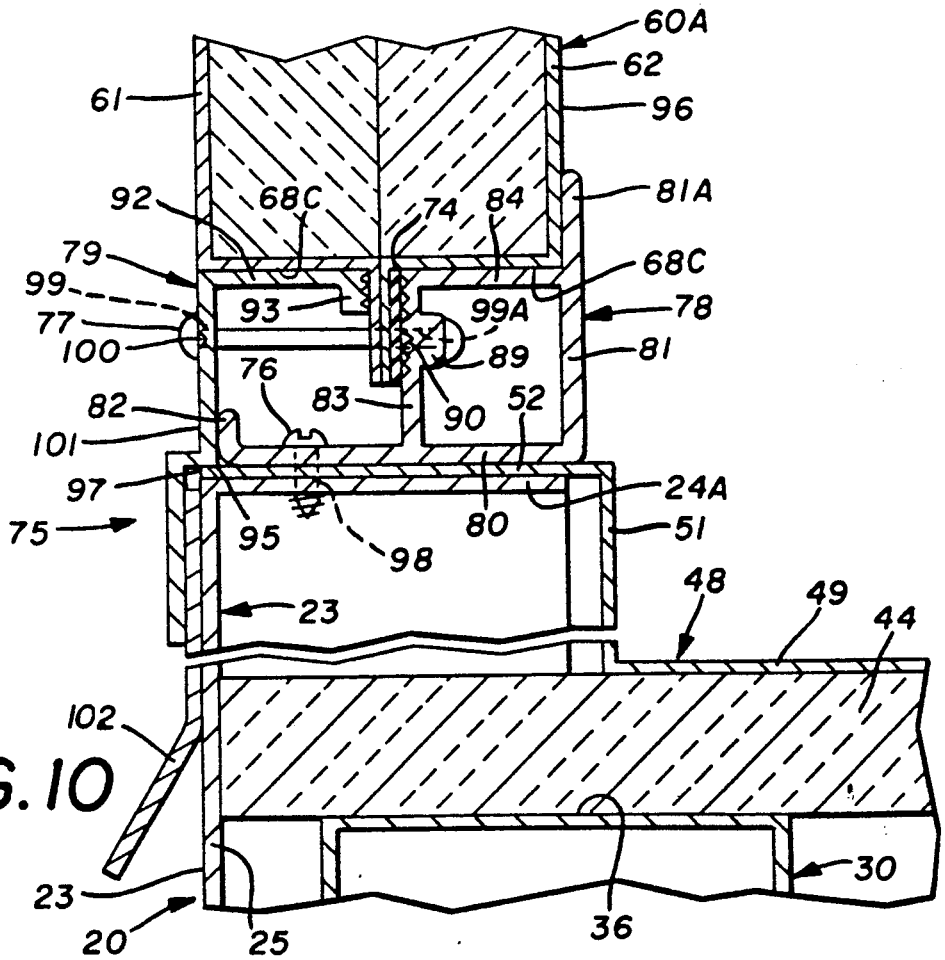
FIG. 10 is an enlarged, vertical section taken substantially along line 10—10 of FIG. 1 depicting an arrangement by which a vertically oriented panel assembly is secured to the base assembly by the sill connector member depicted in FIG. 9 and the sill cover plate depicted in FIG. 8.

Turning now to a description of the typical supporting structures for the wall panel assemblies 60, the horizontally oriented supporting structure includes the sill connector assembly 75 (FIG. 10). The sill connector assembly 75 may be secured to the side rails 23 of the perimeter support portion 21 of the base assembly 20—and through the flanges 52 of the floor pans 48—by a plurality of threaded fasteners 76. Those fasteneres 76 which are not visible from the exterior of the service building 10 may conveniently be self-drilling, self-tapping fasteners such as are sold under the trademark TEK SCREWS. The vertical supporting structure has many forms, examples of which are the linear post assemblies 105, depicted in FIG. 13, the corner post assemblies 135, depicted in FIG. 16, and the T-intersection post assemblies 165, depicted in FIG. 19.

Figure 8:
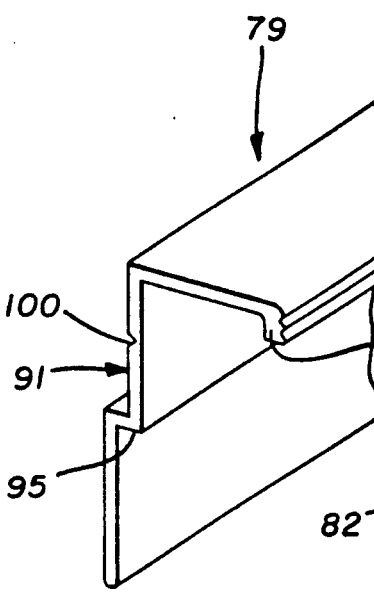
FIG. 8 is a perspective of the sill cover plate embodied in conjunction with the sill connector member depicted in FIG. 9 to form the sill connector assembly operatively depicted in FIG. 10.
Figure 9:
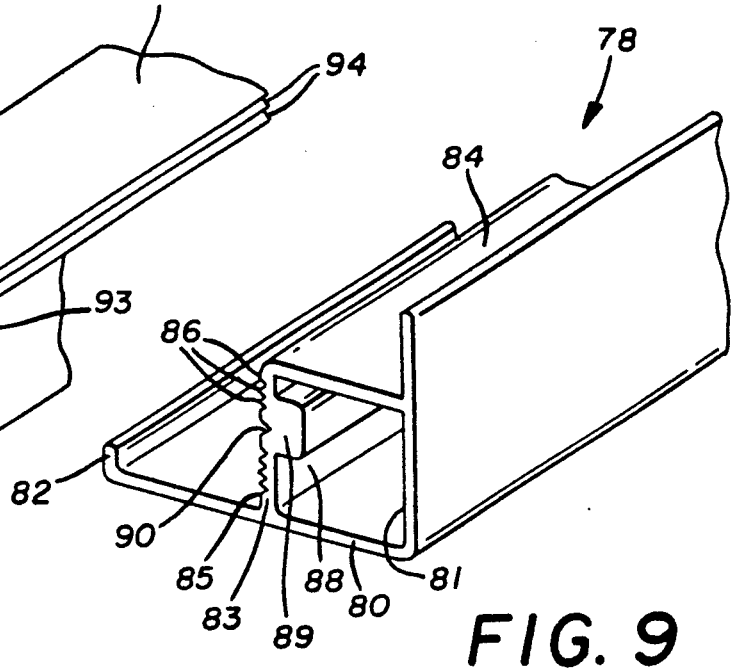
FIG. 9 is a perspective view of the unique sill connector member by which the various vertically oriented members of the service building structure embodying the concepts of the present invention are secured to the perimeter support portion of the base assembly.

To describe the horizontally oriented supporting structure, each sill connector assembly 75 (FIG. 10) has a sill connector member 78 (FIG. 9) and a sill cover plate 79 (FIG. 8) which are secured together by fasteners 77 with an appropriate length of the peripheral flange 69 on one or more wall panel assemblies 60 secured therebetween. At this point it should be noted that all fasteners which are visible from exterior of the building may well be pop rivets. The sill connector member 78 has a base wall 80 which is selectively positioned to rest upon upwardly directed surfaces of the base assembly 20. In the representative example depicted in FIG. 10, the base wall 80 may rest upon a flange 52 (of the pan 48) which overlies the upper ledge 24A of the side rail 23. The base wall 80 could, as well, rest upon a cap 55.

An inner wall 81 extends upwardly from one edge of the base wall 80, and a locating lip 82 extends upwardly from the opposite edge of the base wall 80. A connecting wall 83 extends upwardly from the medial portion of the base wall 80 to intersect, and assist in supporting, the shelf-like abutting wall 84 which is formed integrally with, and extends outwardly from, the inner wall 81. That portion 81A of the inner wall which extends upwardly of the shelf-like abutting wall 84 serves as an orienting flange, as will hereinafter become more apparent. The outer surface 85 of the connecting wall 83 is preferably striated with a plurality of longitudinally extending sealing grooves 86. The opposite, or inner, surface 88 of the connecting wall 83 is provided with an anchor rib 89 which extends longitudinally therealong. A locating groove 90 extends parallel with the sealing grooves 86 to serve as an aligning guide which delineates the longitudinal center of the anchor rib 89. The aligning groove 90 thus facilitates location of the appropriate zone along which the fasteners 77 can penetrate the connecting wall 83 and be effectively received within the anchor rib 89. Typically, the person erecting the service building will utilize the aligning groove 90 to direct the bit when drilling a hole to receive the fasteners 77.

The sill cover plate 79 has a stepped outer wall 91. A top wall 92 extends perpendicularly from the outer wall 91 and terminates in a lip 93 which may also be striated with a plurality of longitudinally extending gripping grooves 94. The step in the outer wall 91 of the sill cover plate 79 presents a locating shoulder 95 which is adapted to engage, for example, the uppermost outer corner 97 on the perimeter support portion 21, as depicted in FIG. 10.

With the sill connector member 78 properly disposed on the perimeter support portion 21, as described, a plurality of longitudinally spaced bores 98 may be drilled through the base wall 80, the flange 52 and into the upper flange 24A of the side rail 23. A self tapping fastener 76 may then be employed to affix the sill connector member 78 to the base assembly 20. Alternatively, the fasteners 76 may be the self-drilling, self-tapping variety previously mentioned. With the sill connector member 78 thus secured, one or more wall panel assemblies 60 may be positioned on the sill connector member 78. Specifically, one side wall 68C on the skin member 62 of a wall panel assembly 60A is rested upon the shelf-like abutting wall 84 of the sill connector member 78 with the facing surface 96 on the skin member 62 of the panel assembly 60 pressed against the orienting flange 81A.

The sill cover plate 79 is then positioned with the stepped locating shoulder 95 on the outer wall 91 thereof resting upon the perimeter support portion 21 of the base assembly 20. The top wall 92 on the sill cover plate 79 will engage the side wall 68C on the skin member 61 of the wall panel assembly 60A. So positioned, the lip 93 on the top wall 92 of the cover plate 79 will engage the flange 69C on skin member 61 of the wall panel assembly 60A in opposition to the outer surface on the connecting wall 83 of the sill connector member 78. When the components of the sill connector assembly 75 are disposed in the manner described the workman may drill a bore 99 through the sill cover plate 79, that same bore extending, as bore 99A, through the peripheral flange 69 on the wall panel assembly 60 and the connecting wall 83 of the sill connector member 78. To facilitate placement of the bore 99, a locating groove 100 may be provided on the exterior surface 101 of the sill cover plate 79. With the stepped locating shoulder 95 engaging the perimeter support portion 21, the locating groove 100 is located on the same level as the locating groove 90 on the connecting wall 83 of the sill connector member 78. Hence, with a little care in aligning the drill bit, the bit will penetrate the perimeter flange 69 and engage the aligning groove 90. By having the bit engage the aligning groove 90 the bore extension 99A being drilled will penetrate the anchor rib 89 properly to accept a fastener 77.

As the fasteners 77 are secured, the lip 93 on the sill cover plate 79 will force the gasket 74 presented from the peripheral flange 69C on skin member 62 of the wall panel assembly 60A into sealing abutment with the striated sealing grooves 86 on the connecting wall 83. This procedure can be accomplished from the outside of the building 10. All of the fasteners 76 which are used to secure the sill connector assembly 75 to the base assembly 20 as well as the fasteners 77 used to secure the wall panel assemblies to the sill connector assembly 75 can be installed from the outside of the building. Thus, the workmen do not have to walk on the floor pans 48 during assembly of the service building 10.

It should be understood that a flashing strip 102 may be positioned between the sill cover plate 79 and the perimeter channel 23, as depicted in FIG. 10 in order to facilitate deflection of water away from the base assembly 20. The flashing strip 102 fills the space between the lower edge of the wall panel assembly 60 and the perimeter channel 23 to provide a relatively smooth exterior to the service building 10 that is a continuation of the outer surface of wall panel assembly 60.

As may now be apparent, the sill connector member 78 and the sill cover plate 79 may conveniently be formed by conventional extrusion processes.

Figure 11:
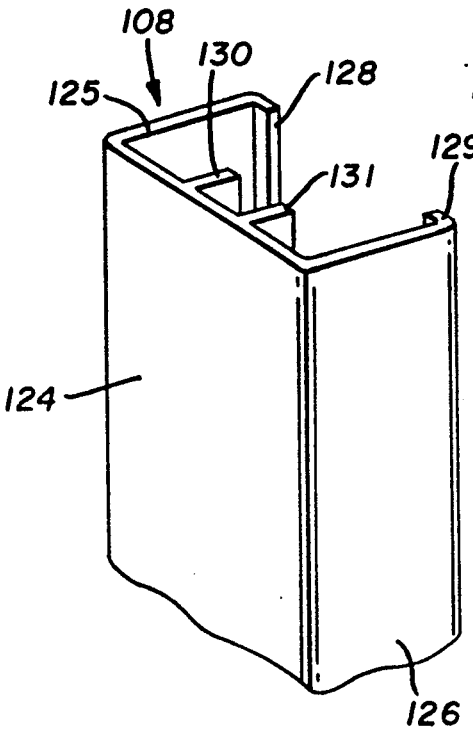
FIG. 11 is a perspective view of a closure mullion which may be employed in conjunction with the post assemblies utilized to conjoin the wall panel assemblies in typical two-panel, and three-panel, intersections.
Figure 12:
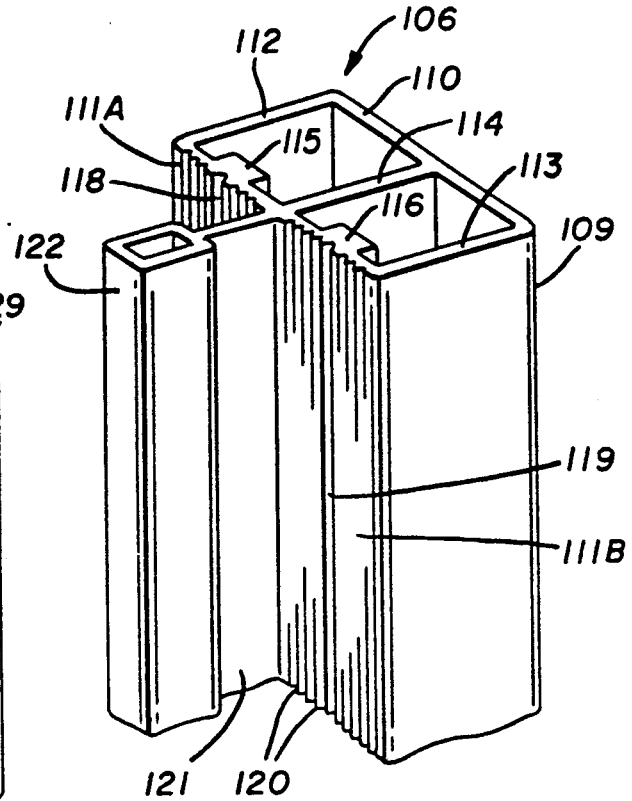
FIG. 12 is a perspective view of an interior support mullion utilized in a linear post assembly embodying the concepts of the present invention.
Figure 13:
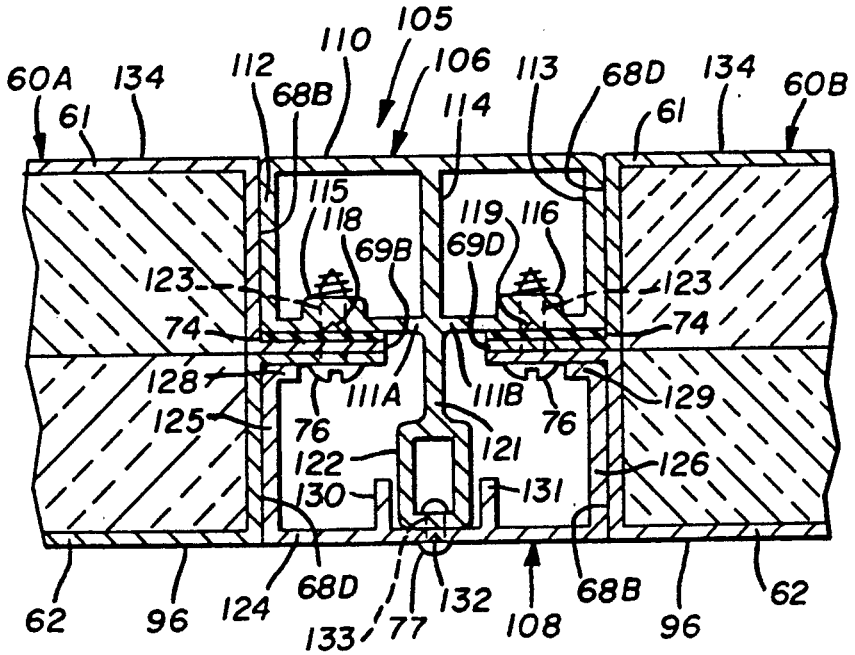
FIG. 13 is an enlarged cross section taken substantially along line 13—13 of FIG. 1 and depicting two successively adjacent panel members oriented in linear, or coplanar, disposition and conjoined by a linear post assembly utilizing an interior support mullion, as depicted in FIG. 12, and a closure mullion, as depicted in FIG. 11.

FIGS. 11 through 13 depict a linear post assembly 105 which is effective to secure two successively adjacent, longitudinally aligned, wall panel assemblies 60.

The assembled linear post assembly 105 which is depicted in FIG. 13 as connecting two, linearly oriented wall panel assemblies 60A and 60B comprises an interior, support mullion 106 (FIG. 12) and an exterior, closure mullion 108 (FIG. 11). The interior support mullion 106 incorporates a boxed, columnar support portion 109 of generally rectilinear cross section. As such, there is an exposed, innermost wall 110, an opposed, composite wall 111 and two abutting walls 112 and 113 which extend between the innermost wall 110 and the composite wall 111 at the lateral sides of the columnar support portion 109. For additional strength one may also employ a web wall 114 which extends between the innermost wall 110 and the composite wall 111 medially of, and parallel with respect to, the two abutting walls 112 and 113. An extension wall 121 extends outwardly from the composite wall 111, preferably in opposition to the web wall 114, and terminates in a head 122 which may be hollow to eliminate unnecessary weight. As such, the extension wall 121 bisects the composite wall 111 into connecting walls 111A and 111B.

A longitudinally extending anchor rib 115 extends along the connecting wall 111A on the interior of the columnar portion 109, and an anchor rib 116 similarly extends along the connecting wall 111B on the interior of the columnar portion 109. As such, one rib is located on either side of the web wall 114 so that anchor rib 115 is disposed to lie between the web wall 114 and the abutting wall 112, and anchor rib 116 is disposed to lie between the web wall 114 and abutting wall 113. Locating grooves 118 and 119 may be provided on the outside of the connecting wall 111A and 111B, respectively, to delineate the longitudinal center of the anchor ribs 115 and 116. In addition to the locating grooves a plurality of laterally spaced, hence striated, sealing grooves 120 extend longitudinally along the face of the connecting walls 111A and 111B in preferably parallel disposition relative to the locating grooves 118 and 119 for a purpose that will hereinafter be more fully explained.

One end of each interior support mullion 106 will rest upon the shelf 84 of the sill connector member 78. As depicted in FIG. 13, the support mullion 106 is disposed vertically with the abutting wall 112 thereof being engaged by the side wall 68B on the skin member 61 of the wall panel assembly 60A and with the other abutting wall 113 being engaged by the side wall 68D on the skin member 61 of the successively aligned wall panel assembly 60B. So positioned, the gasket 74 presented from the peripheral flange 69B on the skin member 61 of wall panel assembly 60A is disposed in contiguous engagement with connector wall portion 111A, and a plurality of fasteners 76 may be employed to secure the wall panel assembly 60A to the interior support mullion 106. Similarly, the gasket 74 presented from the peripheral flange 69D on the skin member 61 of the wall panel assembly 60B is disposed in contiguous engagement with the connector wall portion 111B, and a plurality of fasteners 76 may be employed to secure the wall panel assembly 60B to the interior support mullion 106.

Here, too, if the workman chooses to drill through the peripheral flanges 69, the bit will be guided by the respective locating grooves 118 and 119 to facilitate the location of the resulting bores 123 (FIG. 13) within, or through, the central portion of the anchor ribs 115 and 116, and into which the fasteners 76 may be received. Of course, the fasteners 76 may be of the self-drilling, self-tapping variety. In either event, as the fasteners 76 are tightened, they will force the gasket 74 on each perimeter flange 69 of the wall panel assemblies 60A and 60B into sealing engagement with the striated sealing grooves 120 on the face of that portion 111A and 111B of the connecting wall 111 contacted thereby. This procedure can also be accomplished from the outside of the service building 10. Thus, the workmen do not have to walk on the floor pans 48 during assembly of this portion of the service building 10.

The closure mullion 108 (FIG. 11) has an exposed, outermost wall 124 and a pair of side walls 125 and 126 which extend perpendicularly rearwardly from the lateral edges of the exposed, outermost wall 124 to terminate in engaging lips 128 and 129. A pair of laterally spaced positioning ribs 130 and 131 also extend perpendicularly rearwardly from the outermost wall 124 to embrace the head 122 on the support mullion 106 when the exterior closure mullion 108 is operatively positioned with respect to the interior support mullion 106, as depicted in FIG. 13. As may be observed by reference to FIG. 13, the side wall 125 of the closure mullion 108 may frictionally engage the side wall 68D on the skin member 62 of the wall panel assembly 60A, and the side wall 126 on the closure mullion 108 may frictionally engage the side wall 68B on skin member 62 of the wall panel assembly 60B.

The exterior surface of the outermost wall 124 is preferably provided with a locating groove 132 which designates the center of the head 122 when the head is embraced by the positioning ribs 130 and 131, thus permitting one to drill through the closure mullion 108 and provide a plurality of bores 133 which extends through the outermost wall 124 of the closure mullion 108 and accurately into the center of the head 122 on the interior support mullion 106. A fastener 77 is received within each bore 133 to secure the closure mullion 108 to the support mullion 106. With the closure mullion 108 in place, securing the fasteners 77 to attach the closure mullion 108 to the support mullion 106 drives the engaging lips 128 and 129 on the closure mullion 108 against the full length of the peripheral flanges 69 which engage the connecting wall portions 111A and 111B of the support mullion 106, thereby contributing to the assurance that the entire length of the gaskets 74 which are disposed between the peripheral flanges 69 and the connecting wall portions 111A and 111B are driven into sealing engagement with the striated sealing grooves 120 on each connecting wall portion 111A and 111B further to enhance the seal therebetween. The aforesaid connection of the linearly aligned wall panel assemblies 60A and 60B by use of the linear post assembly 105 also effects an aesthetically pleasing connection. The appearance may, for example, be enhanced by having the facing surfaces 134 on skin members 61 of the wall panel assemblies 60A and 60B disposed in coplanar alignment with the exposed, innermost wall 110 on the interior support mullion 106. In addition, the facing surface 96 on the skin members 62 of the wall panel assemblies 60A and 60B may be disposed in coplanar alignment with the exposed, outermost wall 124 of the closure mullion 108.

Here, too the support mullion 106 and the closure mullion 108 may conveniently be formed by conventional extrusion processes.

Figure 14:
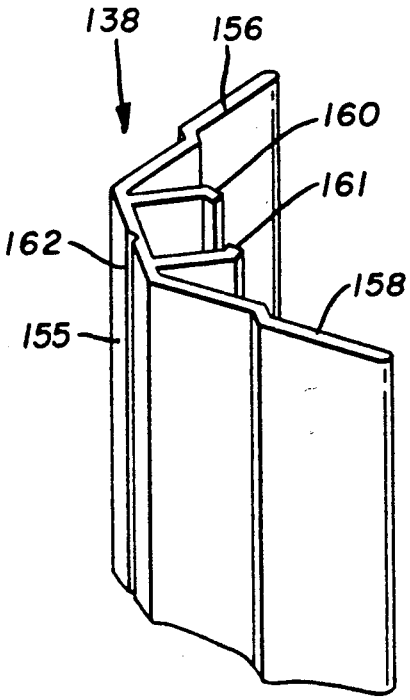
FIG. 14 is a perspective view of a second type of closure mullion, but one which may be employed with an interior mullion of a corner post assembly utilized to conjoin wall panel assemblies at a perpendicular intersection.
Figure 15:
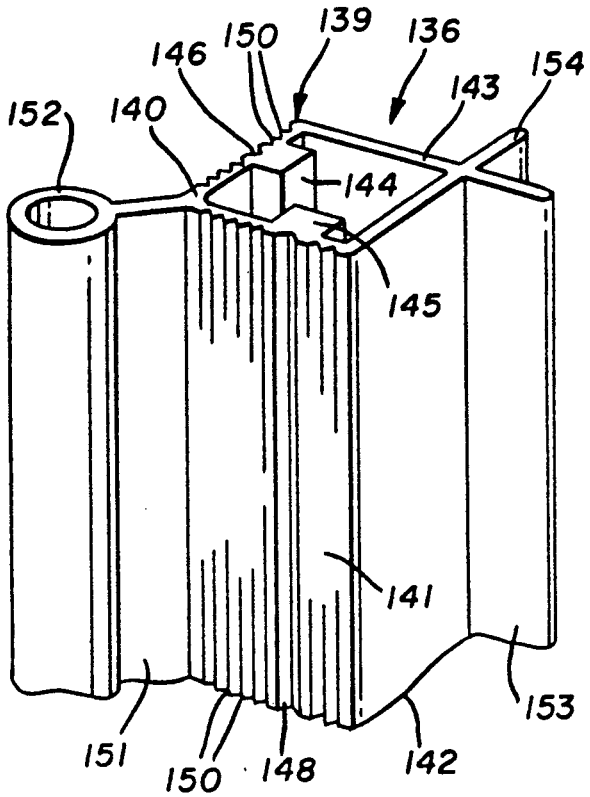
FIG. 15 is a perspective view of a novel, support mullion embodying the concepts of the present invention and utilized to conjoin elements embodying the concepts of the present invention at a two-member, perpendicular intersection.
Figure 16:
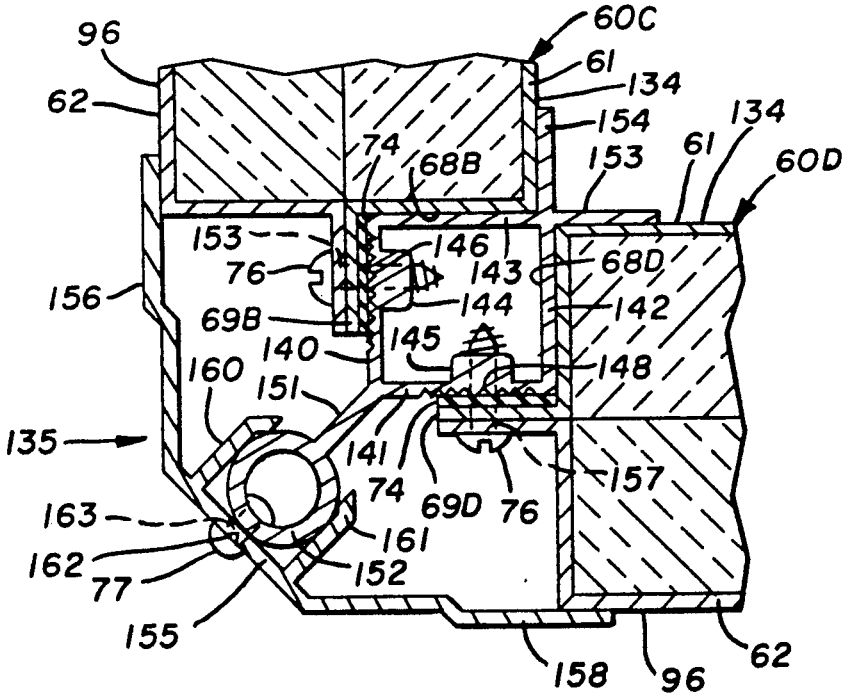
FIG. 16 is an enlarged cross section taken substantially along line 16—16 of FIG. 1 and depicting two successively adjacent wall panel assemblies oriented in perpendicular disposition and conjoined at a corner by a unique corner post assembly utilizing the interior support mullion depicted in FIG. 15, the corner post assembly also incorporating the closure mullion depicted in FIG. 14.

FIGS. 14–16 depict a corner post assembly 135 which is effective to connect two successive wall panel assemblies 60 that converge at substantially right angles to form a corner.

The corner post assembly 135 (FIG. 16) comprises an interior support mullion 136 (FIG. 15) and an exterior closure mullion 138 (FIG. 14). The interior support mullion 136 includes a boxed, columnar support portion 139 of generally rectilinear cross section. As such, there are two connecting walls 140 and 141 which are preferably oriented at right angles, one with respect to the other, and two abutting walls 142 and 143 which are also preferably oriented at right angles, one with respect to the other. The abutting walls 142 and 143 are disposed in opposition to the connecting walls 140 and 141, respectively. An anchor rib 144 extends longitudinally along the connecting wall 140 interiorly of the columnar support portion 139, and an anchor rib 145 similarly extends longitudinally along the connecting wall 141 interiorly on the columnar portion 139. Locating grooves 146 and 148 may be provided on the outside of the connecting walls 140 and 141 to delineate the longitudinal center of the anchor ribs 144 and 145, respectively. In addition to the locating grooves 146 and 148 a plurality of laterally spaced sealing grooves 150 extend longitudinally along the face of the connecting walls 140 and 141, respectively, in preferably parallel disposition relative to the locating grooves 146 and 148.

An extension wall 151 extends outwardly from the intersection of the connecting walls 140 and 141 in alignment with an imaginary diagonal passing between the intersection of the connecting walls 140 and 141 and the opposed intersection of the abutting walls 142 and 143. The extension wall 151 terminates in a head 152 which may also be hollow to eliminate unnecessary weight.

There are two orienting flanges 153 and 154 on the support mullion 136 of the corner post assembly 135. The orienting flange 153 extends at a right angle with respect to the abutting wall 142 and is, therefore, aligned with the abutting wall 143. Similarly, the orienting flange 154 extends at a right angle with respect to the abutting wall 143 and is, therefore, aligned with the abutting wall 142.

One end of each interior support mullion 136 may rest upon the shelf 84 of the sill connector member 78. The support mullion 136 is disposed vertically with the abutting wall 142 thereof being engaged by the side wall 68D on the skin member 61 of the wall panel assembly 60D. When the facing surface 134 on wall panel assembly 60D engages the orienting flange 153, the gasket 74 presented from the peripheral flange 69D on the skin member 61 of wall panel assembly 60D is disposed in contiguous engagement with connector wall 141. So positioned, a plurality of fasteners 76 may be employed to secure the wall panel assembly 60D to the interior support mullion 136. Similarly, with the abutting wall 143 being engaged by the side wall 68B on the skin member 61 of the successively converging wall panel assembly 60C and with the facing surface 134 on wall panel assembly 60C engaging the orienting flange 154, the gasket 74 presented from the peripheral flange 69B on the skin member 61 of the wall panel assembly 60C is disposed in contiguous engagement with the connector wall 140. So positioned, a plurality of fasteners 76 may be employed to secure the wall panel assembly 60C to the interior support mullion 136.

In order to secure the wall panel assemblies 60C and 60D with the fasteners 76, the workman drills through the perimeter flanges 69, and the bit will be guided by the respective locating grooves 146 and 148 to facilitate the location of the fasteners 76 which will either create or be received within the bores 157 (FIG. 16) which extend through the central portion of the anchor ribs 144 and 145 to secure the wall panel assemblies 60C and 60D to the interior support mullion 136. As the fasteners 76 are tightened, they will force the gasket 74 on each perimeter flange 69 of the wall panel assemblies 60C and 60D into sealing engagement with the striated sealing grooves 150 on the connecting wall 140 or 141 contacted thereby. This procedure can also be accomplished from the outside of the service building 10. Thus, the workmen do not have to walk on the floor pans 48 during assembly of this portion of the service building 10.

The closure mullion 138 (FIG. 14) has an outermost wall 155 and a pair of side walls 156 and 158 which extend obliquely from the outermost wall 155. A pair of laterally spaced positioning ribs 160 and 161 also extend perpendicularly from the back of the outermost wall 155 to embrace the head 152 when the exterior closure mullion 138 is operatively positioned with respect to the interior support mullion 136, as depicted in FIG. 16. The exterior surface of the outermost wall 155 is preferably provided with a locating groove 162 which designates the center of the head 152 when the head is embraced by the positioning ribs 160 and 161, thus permitting one to drill through the closure mullion 138 and provide a plurality of bores 163 which extend through the outermost wall 155 of the closure mullion 138 and accurately into the center of the head 152 on the interior support mullion 136. A fastener 77 may be received within each of the bores 163 to secure the closure mullion 138 to the support mullion 136. With the closure mullion 138 in place the side wall 156 may embracingly engage the facing surface 96 on the skin member 62 of wall panel assembly 60C, and the side wall 158 may embrace the facing surface 96 on the skin member 62 of the wall panel assembly 60D. The afore-described connection of successively converging wall panel assemblies 60C and 60D is thereby aesthetically accomplished.

Here, too the support mullion 136 and the closure mullion 138 may conveniently be formed by conventional extrusion processes.

Figure 17:
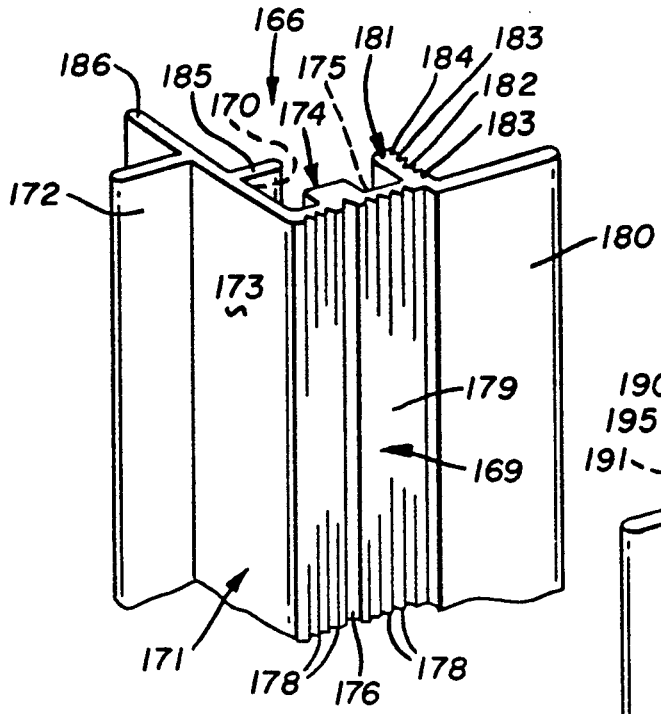
FIG. 17 is a perspective view of a two panel connecting mullion utilized in a T-intersection post assembly embodying the concepts of the present invention.
Figure 18:
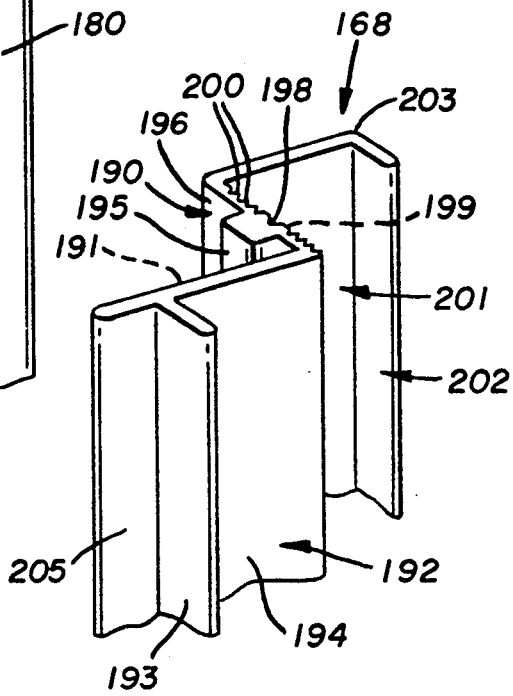
FIG. 18 is a perspective view of the third panel connecting mullion utilized in a T-intersection post assembly embodying the concepts of the present invention.
Figure 19:
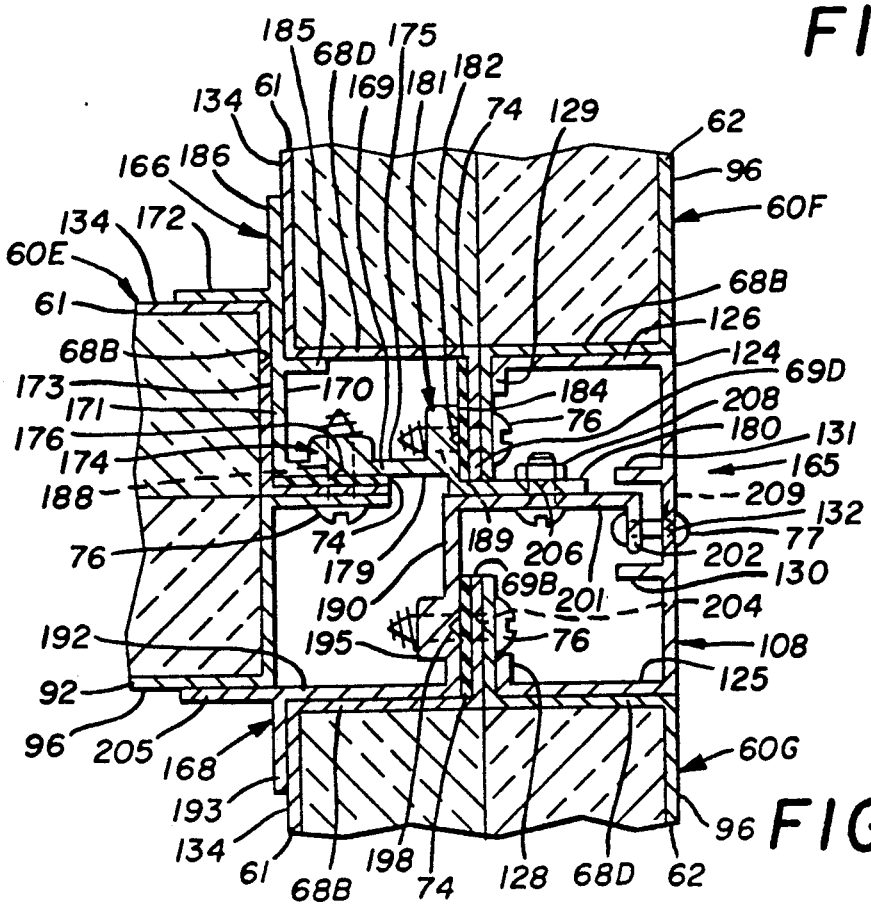
FIG. 19 is an enlarged cross sectional view taken substantially along line 19—19 of FIG. 1 and depicting three, convergingly adjacent wall panel assemblies oriented in an intersecting disposition and conjoined by a T-intersection post assembly incorporating the two panel connector mullion depicted in FIG. 17 and the third panel connector mullion depicted in FIG. 18, the T-intersection post assembly also incorporating a closure mullion of the type depicted in FIG. 11.

The T-intersection post assembly 165 depicted in FIG. 19 employs a two piece supporting structure—i.e., a two-panel connecting mullion 166 (FIG. 17) and a third-panel connecting mullion 168 (FIG. 18)—and the same closure mullion 108 depicted in FIG. 11. Neither of the connecting mullions 166 nor 168 incorporate a boxed portion, and yet because of the fact that they have an angular and a generally Z-shaped configuration, respectively, they each contribute to the columnar support provided by the overall T-intersection post assembly 165.

The two-panel connecting mullion 166 has a first connecting wall 169 which extends substantially perpendicularly outwardly from the reverse face 170, and at one lateral edge of, an abutting wall 171. A first, orienting flange 172 extends substantially outwardly from the obverse face 173 of the first abutting wall 171 in spaced relation from the first connecting wall 169, and therefore in a direction oppositely from that at which the first connecting wall 169 extends with respect to the first abutting wall 171. A first anchor rib 174 extends longitudinally along the reverse face 175 of the first connecting wall 169, and a locating groove 176 may be provided on the obverse face 179 of the first connecting wall 169 to delineate the longitudinal center of the anchor rib 174. In addition, to the locating groove 176 a plurality of laterally spaced, striated sealing grooves 178 also extend longitudinally along the obverse face 179 of the first connecting wall 169 in preferably parallel disposition relative to the locating groove 176.

A joinder flange 180 extends outwardly from, and in substantial alignment with, the first connecting wall 169. At the juncture of the first connecting wall 169 and the joinder flange 180 a second connecting wall, and combined anchor rib, 181 extends perpendicularly from the reverse face 175 of the first connecting wall 169. By thus combining the connecting wall and the corresponding anchor rib into one common structural element 181 it may not be absolutely necessary to provide a locating groove 182, but the presence of the locating groove 182 assists in effectively identifying a propitious location for placing the fasteners 76 by which a peripheral flange 69 may be secured thereto. In addition to the locating groove 182 a plurality of laterally spaced, striated sealing grooves 183 also extend longitudinally along the obverse face 184 of the combined second connecting wall and anchor rib 181 in preferably parallel disposition relative to the locating groove 182.

A second abutting wall 185 extends outwardly from the reverse face 170 of the first abutting wall 171 in general opposition to, but offset from, the first orienting flange 172, and a second orienting flange 186 extends outwardly in substantially perpendicular disposition with respect to the second abutting wall 185 and said first orienting flange 172. As such, the second innermost wall 186 extends outwardly in substantial alignment with said first abutting wall 171.

One end of the two-panel connecting mullion 166 in each T-intersection post assembly 165 will rest upon the shelf 84 of the sill connector member 78. The two-panel connecting mullion 166 is disposed vertically with the abutting wall 171 thereof being engaged by the side wall 68B on the skin member 61 of the wall panel assembly 60E. When the facing surface 134 on wall panel assembly 60E engages the first orienting flange 172, the gasket 74 presented from the peripheral flange 69B on the skin member 61 of wall panel assembly 60E is disposed in contiguous engagement with connector wall 171. So positioned, a plurality of fasteners 76 may be employed to secure the wall panel assembly 60E to the two-panel connecting mullion 166. Similarly, with the abutting wall 185 being engaged by the side wall 68D on the skin member 61 of the successively converging wall panel assembly 60F and with the facing surface 134 on wall panel assembly 60F engaging the second orienting flange 186, the gasket 74 presented from the peripheral flange 69D on the skin member 61 of the wall panel assembly 60F is disposed in contiguous engagement with the combined connector wall and anchor rib 181. So positioned, a plurality of fasteners 76 may be employed to secure the wall panel assembly 60F to the two-panel connector mullion 166.

In order to secure the wall panel assemblies 60E and 60F with the fasteners 76, the workman will be guided by the respective locating grooves 176 and 182 to locate the bores 188 and 189 (FIG. 19) within, or through, the central portion of the anchor rib 174 and the combined connector wall and anchor rib 181. The bores 188 and 189 are created by, or provided for, the fasteners 76 to secure the wall panel assemblies 60E and 60F to the two-panel connector mullion 166. As the fasteners 76 are tightened, they will force the gasket 74 on each perimeter flange 69 of the wall panel assemblies 60E and 60F into sealing engagement with the striated sealing grooves 178 and 183 on the respective connecting walls 169 and 181 contacted thereby.

The third-panel connecting mullion 168 (FIG. 18) has a connecting wall 190 which extends substantially perpendicularly outwardly from the reverse face 191, and at one lateral edge of, an abutting wall 192. A first, orienting flange 193 extends substantially outwardly from the obverse face 194 of the abutting wall 192 in spaced relation from the connecting wall 190, and therefore in a direction oppositely from that at which the connecting wall 190 extends with respect to the abutting wall 192. An anchor rib 195 extends longitudinally along the reverse face 196 of the connecting wall 190, and a locating groove 198 may be provided on the obverse face 199 of the connecting wall 190 to delineate the longitudinal center of the anchor rib 195. In addition, to the locating groove 198 a plurality of laterally spaced, striated sealing grooves 200 also extend longitudinally along the obverse face 199 of the connecting wall 190 in preferably parallel disposition relative to the locating groove 198.

A joinder flange 201 extends outwardly from, and in substantially perpendicular disposition with respect to, the connecting wall 190. A return flange 202 extends perpendicularly from the outboard edge 203 of the joinder flange 201 to enhance the beam strength of the joinder flange 201.

One end of the third-panel connecting mullion 168 in each T-intersection post assembly 165 will also rest upon the shelf 84 of the sill connector member 78. The third-panel connecting mullion 168 is disposed vertically with the abutting wall 192 thereof being engaged by the appropriate side wall 68B on the skin member 61 of the wall panel assembly 60G and with the facing surface 134 on the skin member 61 of the wall panel assembly 60G engaging the orienting flange 193. So positioned, the gasket 74 presented from the peripheral flange 69B on the skin member 61 of the wall panel assembly 60G is disposed in contiguous engagement with the connecting wall 190, and a plurality of fasteners 76 may be employed to secure the wall panel assembly 60G to the third-panel connecting mullion 168 of the T-intersection post assembly 165. Here, too, the workman will be guided by the locating groove 198 in the same manner as previously described to locate the bores 204 (FIG. 19) within, or through, the central portion of the anchor rib 195. Fasteners 76 are received within the bores 204 to secure the wall panel assembly 60G to the third panel connecting mullion 168. Similarly, too, as the fasteners 76 are tightened, they will force the gasket 74 on the perimeter flange 69B on the skin member 61 of the wall panel assembly 60G into sealing engagement with the striated sealing grooves 200 on the connecting wall 190 contacted thereby.

A second orienting flange 205 is also presented from the third panel supporting mullion 168. The second orienting flange 205 extends outwardly in substantial alignment with the abutting wall 192. The orienting flange 205 engages the facing surface 96 on the skin member 62 of the wall panel assembly 60E when the third panel supporting mullion 168 is properly disposed with respect to the two-panel supporting mullion 166 in the T-intersection post assembly 165. At the same time the joinder flange 201 on the third-panel supporting mullion 168 is disposed in contiguous juxtaposition with the joinder flange 180 on the two-panel supporting mullion 166. A locating groove 206 extends axially along the joinder flange 180 to facilitate the most appropriate location for the means by which to secure the joinder flanges 180 and 201. As shown, a nut and bolt arrangement 208 may be employed.

With the third-panel connecting mullion 168 thus secured to the two-panel connecting mullion 166, a closure mullion 108 (of the type depicted, and described, in conjunction with FIG. 11) may employed to provide a finished exterior surface to the T-intersection post assembly 165. The side wall 125 of the closure mullion 108 engages the side wall 68D on the skin member 62 of wall panel assembly 60G, and the side wall 126 engages the side wall 68B on the skin member 62 of wall panel assembly 60F. So positioned the ribs 130 and 131 embrace the return flange 202 presented from the outboard edge 203 of the joinder flange 201. By drilling a plurality of longitudinally spaced bores 209 along the locating groove 132 presented form the outermost wall 124 of the closure mullion 108, one can utilize a plurality of the fasteners 77 to secure the closure mullion 108 to the return flange 202, and thus to the T-intersection post assembly 165. The engaging lips 128 and 129 on the closure mullion 108 engage the perimeter flanges 69 on the wall panel assemblies 60G and 60F, respectively, to assure that the outermost wall 124 on the closure mullion 108 is disposed in coplanar alignment with the facing 96 on the aligned panel assemblies 60G and 60F.

Figure 20:
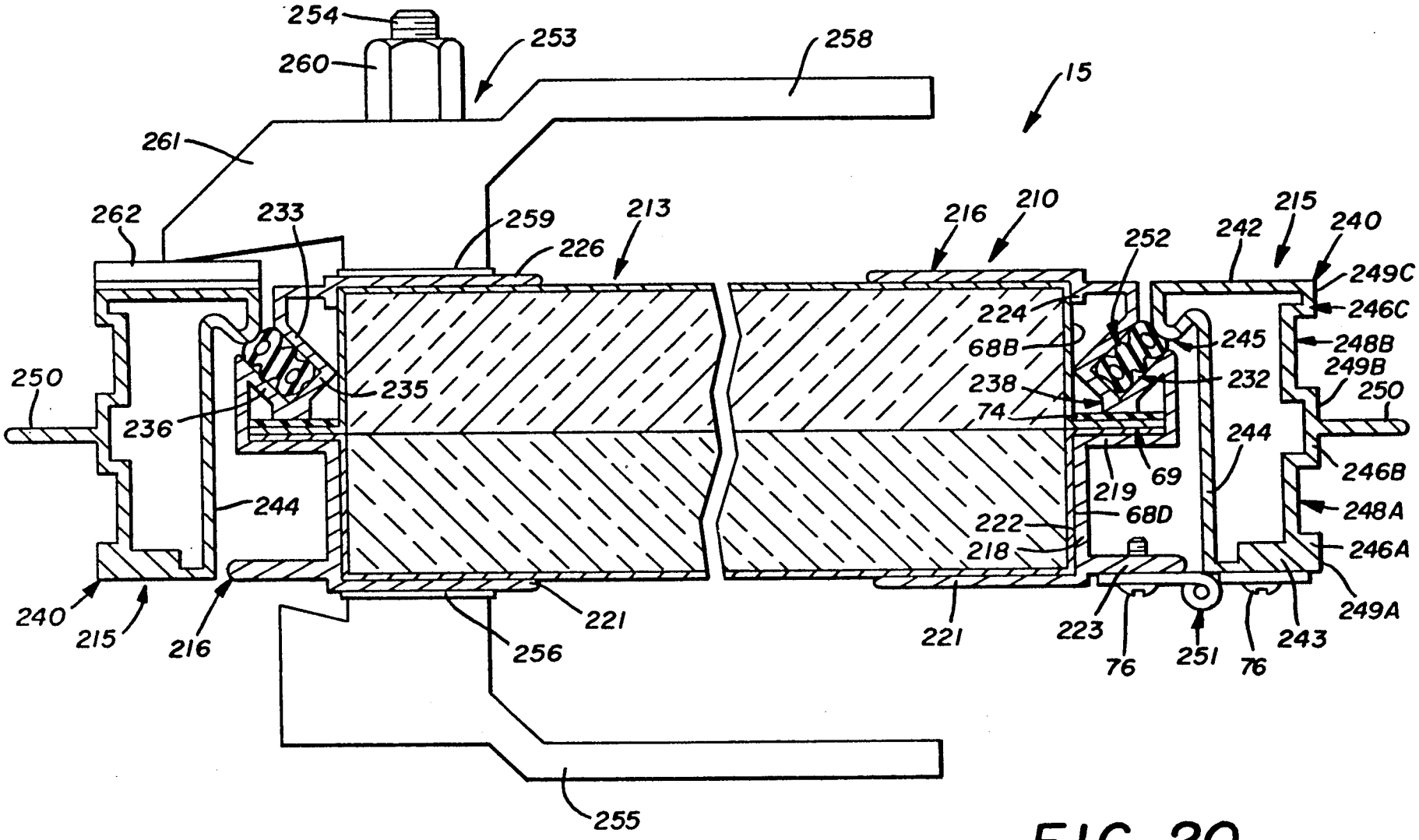
FIG. 20 is an enlarged cross sectional view taken substantially along line 20—20 of FIG. 1 and depicting the interrelation of a door panel assembly, a perimeter mullion assembly surrounding the door panel assembly and the door jamb assembly.

As noted, a typical service building 10 may have one or more doors 15 which may be constructed as shown in FIG. 20. The door 15 has a perimeter mullion assembly 210 which surrounds a door panel assembly 213. The door panel assembly 213 may preferably be constructed in a manner virtually identical with the wall panel assembly 60. A door jamb assembly 215, in turn, surrounds the perimeter mullion assembly 210 to delineate the opening in the service building 10 within which to receive the door 15.

Figure 21:
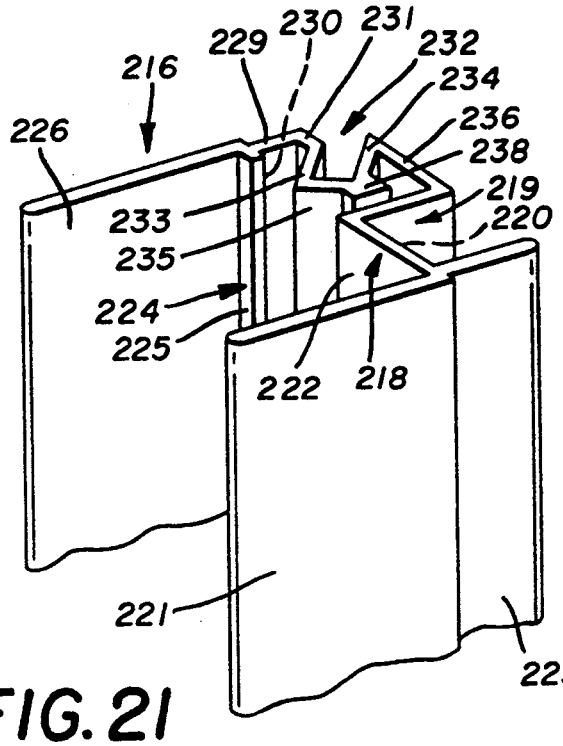
FIG. 21 is a perspective view of a door mullion employed in the perimeter mullion assembly of the door and utilized in the arrangement depicted in FIG. 20.

The perimeter mullion assembly 210 is constructed by joining four lengths of a door mullion 216, the cross section of which is best depicted in FIG. 21. The configuration of the door mullion 216 is such that the end of each may be mitered and the mitered ends joined, as by welding, with a door panel assembly 213 confined within the four lengths of the door mullion 216 that are conjoined in a perimeter mullion assembly 210 which circumscribes the door panel assembly 213.

With particular reference to FIG. 21 it can best be seen that the door mullion 216 has an abutting wall 218 with a connecting wall 219 extending perpendicularly outwardly from the reverse face 220 of the abutting wall 218, and at one lateral edge thereof. At the opposite lateral edge of the abutting wall 218 a first confining wall 221 extends outwardly from the obverse face 222 of the abutting wall 218. In generally opposed relation to the first confining wall 221, but preferably laterally offset therefrom, a hinge mounting flange 223 extends outwardly from the reverse face 220 of the abutting wall 218.

An abutting stub 224 is disposed in spaced opposition to the abutting wall 218. The obverse face 225 on the abutting stub 224 is coplanar with the obverse face 222 on the abutting wall 218 to facilitate the proper orientation between each length of the door framing mullion 216 and the door panel assembly 213 surrounded thereby. A second confining wall 226 extends outwardly from the obverse face 228 of the abutting stub 224 at one lateral edge thereof. In generally opposed relation to the second confining wall 226, but preferably laterally offset therefrom, an extension wall 229 extends outwardly from the reverse face 230 of the abutting stub 224 to terminate in an offsetting wall 231 which merges with one side wall 233 of a seal retaining cavity 232.

The seal retaining cavity 232 has a pair of spaced apart, obliquely oriented, side walls 233 and 234 connected by an end wall 235. As noted, the side wall 233 intersects, and is joined to, the offsetting wall 231, and the side wall 234 similarly intersects, and is joined to, one edge of the peripherally outermost wall 236. The opposite edge of the peripherally outermost wall 236 joins the connecting wall 219.

A gasket compressing head 238 is presented from the intersection of the side wall 234 and the end wall 235. The compressing head 238 is disposed in opposition to the connecting wall 219, and is spaced therefrom at a dimension sufficient to provide a modest compression to the gasket 74 on the perimeter flange 69 of the door panel assembly 213, as follows.

With reference to FIG. 20, it will be observed that the peripheral flange 69 on the door panel assembly 213 (which may well be structurally identical with the wall panel assembly 60) is disposed in contiguous juxtaposition with the connecting wall 219, and the gasket 74 presented from the peripheral flange 69 is compressively engaged by the compression head 238 to effect a seal between the door panel assembly 213 and the perimeter mullion assembly 210. It should be appreciated that even though the door panel assembly 213 may be made in the same manner as the wall panel 60 disclosed herein, in order to assure the proper seating of the peripheral flange 69 between the connecting wall 219 and the compression head 238, the staking protuberance 72 on the peripheral flange 69, if the staking connection is employed, may be at least partially driven into the perimeter flange 69 to facilitate insertion of the flange 69 between the connecting wall 219 and the compression head 238.

The side wall 68D of the door panel assembly 213 is engaged by the obverse face 222 on the abutting wall 218, and the side wall 68B is engaged by the obverse face 225 on the abutting stub 224 when the door mullion 216 is properly disposed with respect to the door panel assembly 213. When all four lengths of door mullion 216 which surround the door panel assembly 213 are so disposed with respect to the door panel assembly 213, the lengths of the door mullion 216 may be welded together to complete the configuration of the door 15.

Figure 22:
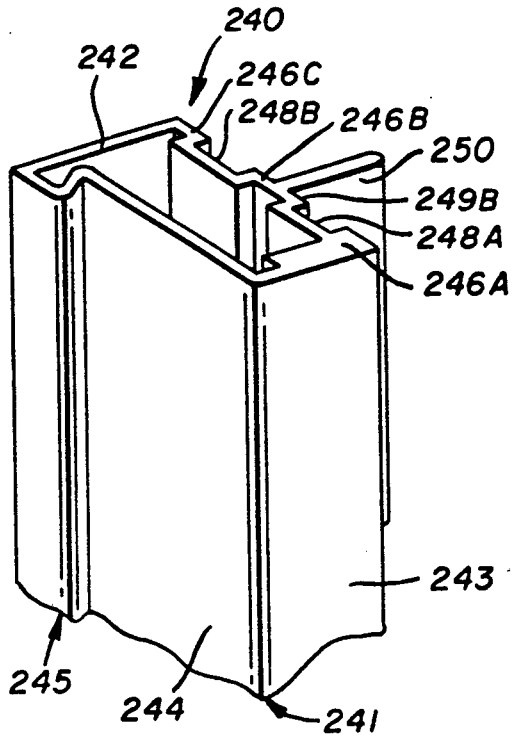
FIG. 22 is a perspective view of a door frame supporting mullion employed in the door jamb assembly, also as utilized in the arrangement depicted in FIG. 20.

The door jamb assembly 215 is constructed by joining four lengths of a door frame supporting mullion 240, the cross section of which is best depicted in FIG. 22. The configuration of the door frame supporting mullion 240 is such that the ends of each length may be mitered and the mitered ends joined, as by welding, to form a door jamb assembly 215. The door jamb assembly 215 delineates the opening within which the door 15 is received.

With particular reference to FIG. 22 it can best be seen that the door frame supporting mullion 240 includes a boxed, columnar support portion 241. One lateral side of the boxed columnar portion 241 presents the exposed, innermost wall, or reveal, 242, and the laterally opposite wall of the columnar portion 241 presents a hinge mounting wall 243. A jamb wall 244 is joined to one edge of the hinge mounting wall 243. The jamb wall 244 terminates in a door stop 245 which extends between the jamb wall 244 and one edge of the exposed, innermost wall 242. The side of the columnar support portion 241 opposite the jamb wall 244 comprises three locating walls 246A, 246B and 246C and a pair of recessed wall 248A and 248B located between the three locating walls 246A–246C.

The locating wall 246A extends transversely from the second edge of the hinge mounting wall 243 in spaced relation from the jamb wall 244. The locating wall 245C extends transversely from the second edge of the innermost wall 242, and the locating wall 245B is located medially of the locating walls 245A and 245C. The obverse faces 249A–249C on the locating walls 246A–246C, respectively, are coplanar for a purpose more fully hereinafter described.

The recessed wall 248A joins the locating wall 246A to locating wall 246B, and recessed wall 248B joins locating wall 246B to locating wall 246C. By thus offsetting the recessed walls 248A and 248B one can further enhance the columnar strength of the boxed columnar support portion 241 but in addition, such an arrangement facilitates joinder of the columnar support portion 241 to successive components. For that purpose the medially disposed locating wall 246B has a connecting wall 250 extending perpendicularly outwardly from the obverse face 249B of the locating wall 246B.

The connecting wall 250 has the same configuration as the perimeter flange 69 on the wall panel assembly 60 and similarly permits the door frame supporting mullion 240 to be conjoined to any of the post assemblies 105, 135 or 165. That is, the locating walls 246A–246C simulate the side walls 68 of a wall panel assembly 60, and the connecting wall 250 simulates the peripheral flange 69. As such, the mode by which the selected post assembly 105, 135 or 165 is secured to the door frame supporting mullion 240 should be apparent in view of the foregoing explanations as to how those post assemblies are secured to the wall panel assemblies 60.

The door 15 may be mounted on the door jamb assembly 215 for swinging movement, for example, by virtue of a piano type hinge 251 (FIG. 20) which is secured, as by fasteners 76, not only to the hinge mounting flange 223 on the door mullion 216 but also to the hinge mounting wall 243 on the door frame, supporting mullion 240. It will be noted that the hinge mounting flange 223 as well as hinge mounting wall 243 are preferably made thicker than the other walls of the door mullion 216 and the door frame supporting mullion 240, respectively, in order to allow a sufficient anchor for the fasteners 76 by which the hinge 251 may be secured to the perimeter mullion assembly 210 and the door jamb assembly 215.

An elastomeric seal 252 is received within the seal retaining chamber 232, which extends about the entire periphery of the door 15, sealingly to engage the door stop 245 on the door frame supporting mullion 240 when the door 15 is closed.

The door 15 may also utilize one or more combined door handles and locking devices 253. The exemplary arrangement depicted in FIG. 20 employs a rotatable mounting bolt 254 with a first handle 255 affixed to one end thereof. The base portion 256 of the first handle 255 may be rotatably received against the first confining wall 221, and with the mounting bolt 254 disposed to so position the first handle 255, a second handle 258 may be non rotatably, as by splines (not shown), received on the end of the mounting bolt projecting through the second confining wall 226. The base portion 259 of the second handle 258 rotatably engages the second confining wall 226 and so positioned, the second handle is secured to the mounting bolt 254 by a nut 260. The second handle 258 may present a latch extension 261 which cooperatively engages a latch plate 262 secured, for example, to the innermost wall 242 of the adjacent door frame supporting mullion 240 of the door jamb assembly 215.

Figure 25:
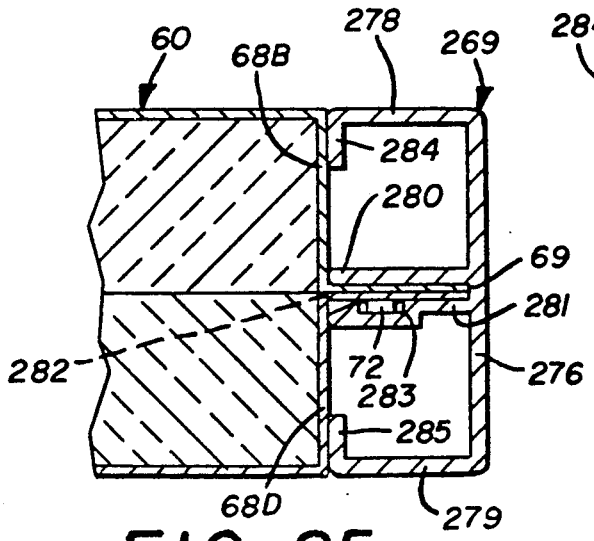
FIG. 25 is a cross sectional view appearing on the same sheet of drawings as FIG. 7 and depicting the interconnection between a wall panel assembly and a slotted frame cap adapted for utilization along the edge of a panel assembly.

If desired, one or more apertures 16 can penetrate the wall panels 60. Typically, an aperture 16 may be cut through a wall panel assembly 60 and then framed by either a frame cap 266, (FIG. 23), a frame post 268 (FIG. 23) or a slotted frame cap 269 (FIGS. 24 and 25). Moreover, the aperture 16 can be framed by any combination of the aperture framing members 266, 268 or 269.

Figure 23:
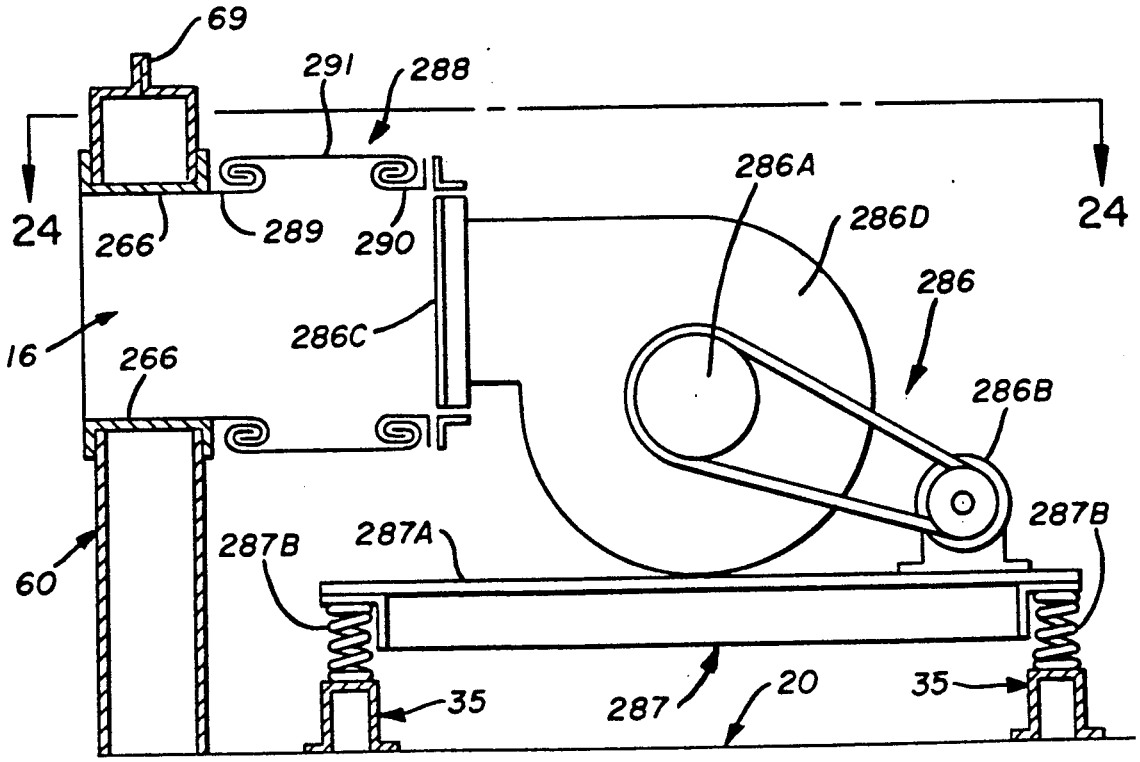
FIG. 23 is a schematic, vertical, cross sectional view, partly in elevation, depicting a novel interconnection between an accessory component, such as a fan, located interiorly of the service building structure and communicating with the exterior of the service building structure by virtue of a through-the-wall aperture defined by unique structural components embodying the concepts of the present invention.
Figure 24:
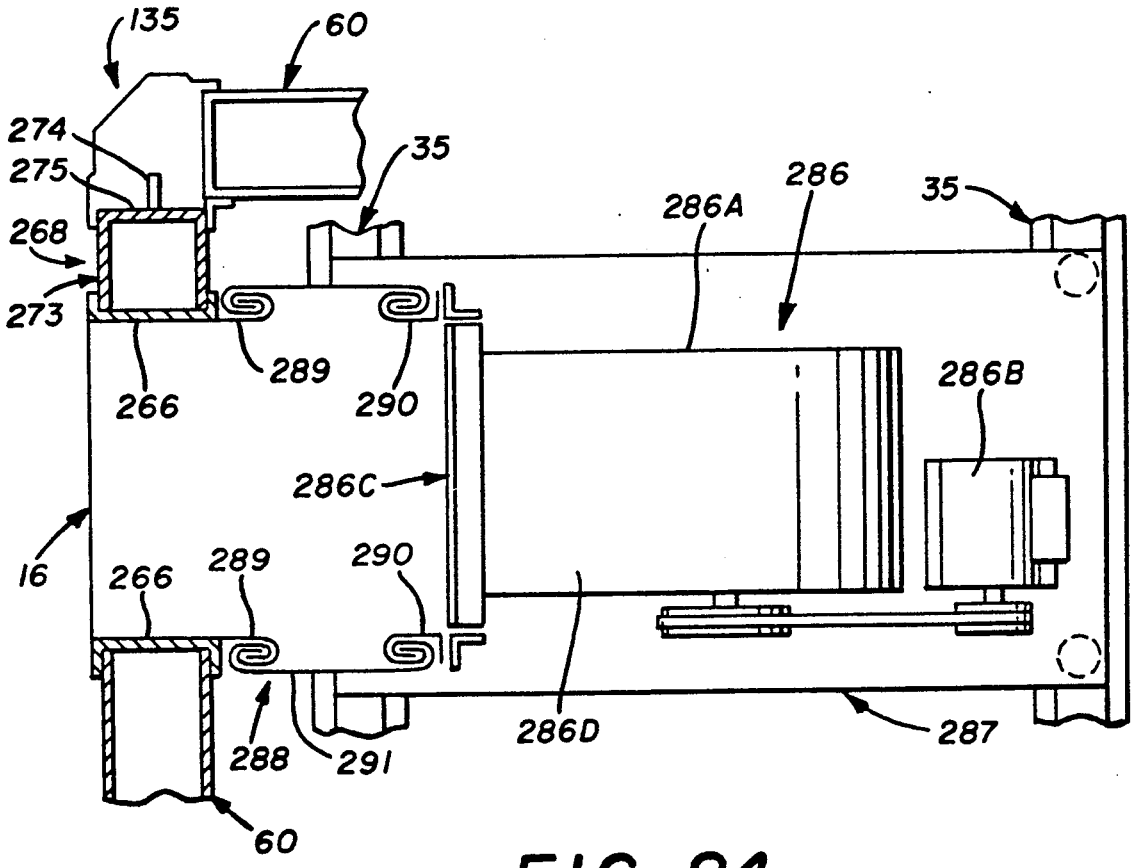

As represented in FIG. 23, the frame cap 266 and the frame post 268 are used to frame opposite sides of the aperture 16.

The frame cap 266 is essentially a channel-shaped, or U-shaped, member which has a web wall 270 and a pair of laterally spaced side flanges 271 and 272. The frame cap 266 may be secured to a wall panel assembly 60 by a plurality of fasteners 76 which extend through one, or both, side flanges 271 and 272 and into the adjacent skin member 61 and 62 of the wall panel assembly 60. By virtue of the fact that the fasteners 76 extend into only the relatively thin metal of the skin members 61 and/or 62, the frame cap 266 is only employed in situations where relatively little force will be applied to the aperture framing member.

The frame post 268 has a body portion 273 with a rectilinear cross section. A connecting flange 274 extends outwardly from one of the walls 275 in the body portion 273. As such, the wall 275 and the connecting flange 274 simulate a side wall 68 and the peripheral flange 69, respectively, of a wall panel assembly 60. This configuration permits the frame post 268 to be employed at any location where it can be secured to one of the post assemblies 105, 135 or 165 in the same manner as a wall panel assembly 60.

Figure 26:
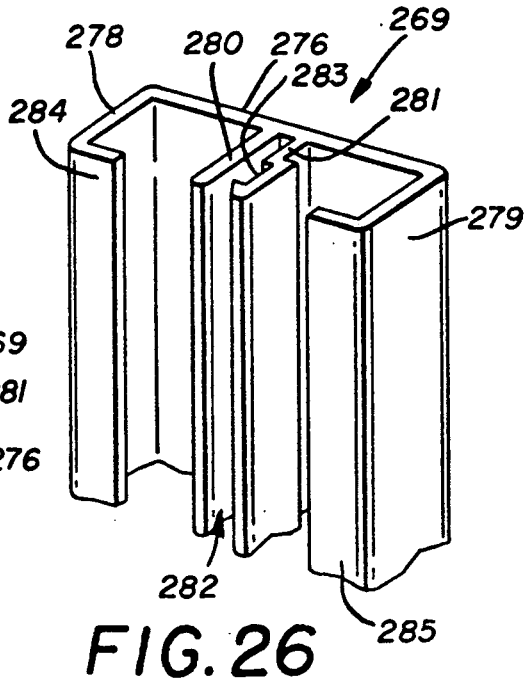
FIG. 26 is a perspective view of the slotted frame cap depicted in FIG. 25 and also appearing on the same sheet as FIG. 7.

The slotted frame cap 269 (FIG. 26) has a web wall 276 and a pair of lateral side wall 278 and 279. A pair of parallel, spaced, connecting flanges 280 and 281 extend outwardly from the medial portion of the web wall 276 to define a slot 282 therebetween which is adapted to receive the peripheral flange 69 of a wall panel assembly 60. The connecting flange 281 may even be provided with a recess 283 which will accept the staking protuberances 72 on the peripheral flange 69. The peripheral flange 69 can be positioned within the slot 282 by sliding the frame cap 269 along the perimeter flange 69 or by snapping the frame cap 269 over the perimeter flange 69. The gasket 74 can be omitted if the slot 282 is sized snugly to engage the perimeter flange 69. As such, the frame post 269 can interact with the staking protuberances 72, as depicted in FIG. 25, to effect the necessary connection between the frame post 268 and the wall panel assembly 60, and the foot flanges 284 and 285 on the side walls 278 and 279, respectively, engage the side walls 68B and 68D, respectively, to stabilize the slotted frame cap 269 with respect to the wall panel assembly 60.

Equipment, such as a fan assembly 286, may be supported within the service building 10 in such a way as to communicate with the exterior of the building through an aperture 16. With particular reference to FIGS. 23 and 24, the fan assembly 286 comprises a fan 286A and a motor 286B that can be carried on the table 287A of a well known, vibration damping support assembly 287 which, in turn, rests upon a plurality of springs 287B supported from a successively adjacent pair of hat supports 35 in the base assembly 20. The fan assembly 286 may be connected to the aperture 16 by a conventional, vibration insulating, connector assembly 288. The connector assembly 288 utilized opposed pairs of metal attaching members 289 and 290 and an elastomeric sleeve 291 which is crimped to the attaching members 289 and 290. The attaching members 289 and 290 are secured to the frame caps 266 which define the perimeter of the aperture 16 as well as to the mouth 286C of the fan volute 286D. As such, the elastomeric sleeve 291 isolates vibrations of the fan assembly 286 from being transmitted to the service building 10.

Figure 27:
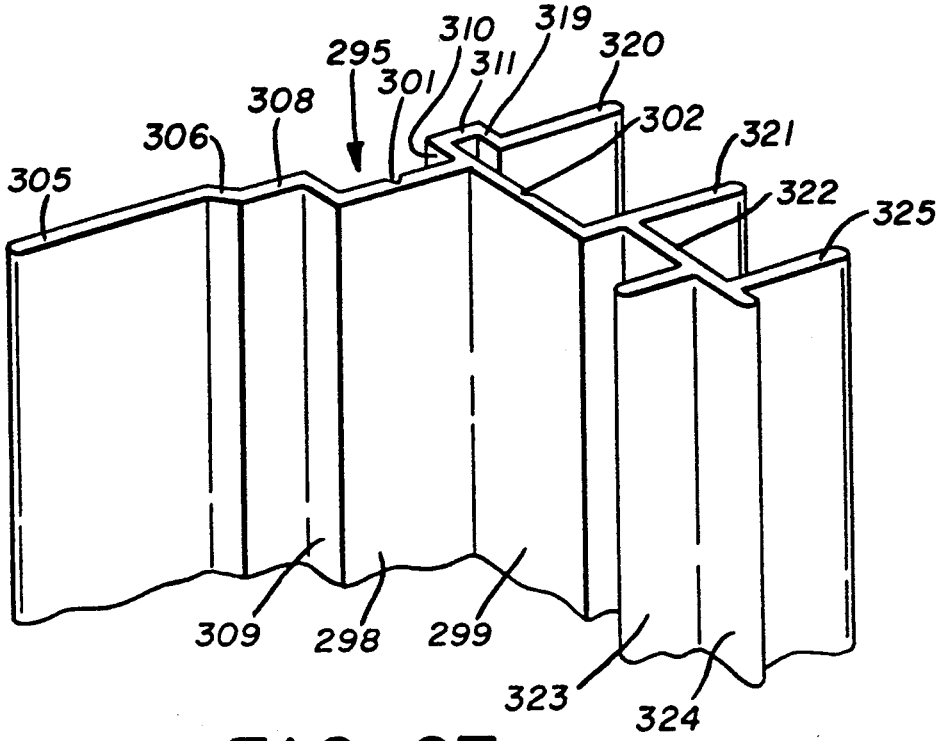
FIG. 27 is a perspective view of a transitional connector member embodying the concepts of the present invention.
Figure 28:
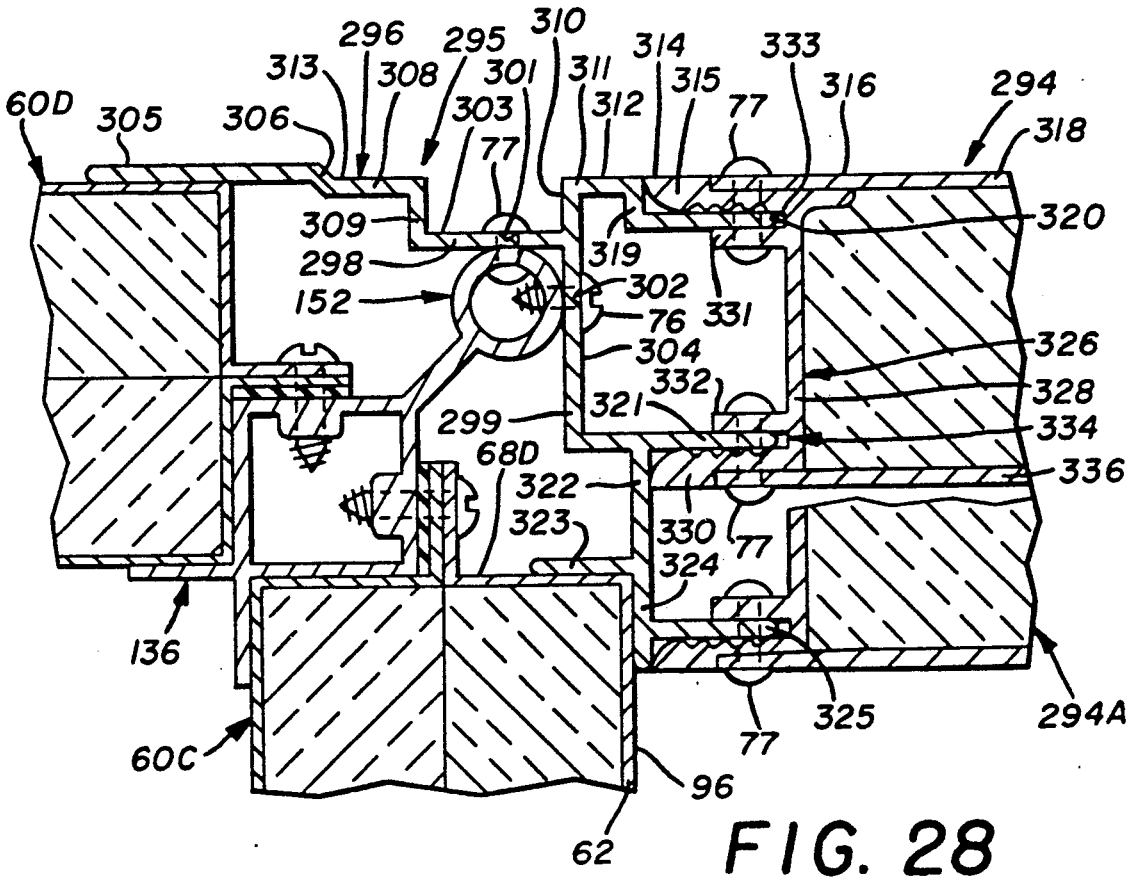
FIG. 28 is a cross sectional view depicting transitional connector assembly—i.e.: two successively adjacent panels embodying the concepts of the present invention, and oriented in perpendicular disposition, are conjoined at a transitional corner by the two panel connecting mullion depicted in FIG. 15 and the transitional connector mullion depicted in FIG. 27 is employed to conjoin a panel member of the type disclosed in U.S. Pat. No. 4,754,587 in the transitional connector assembly.
Figure 29:
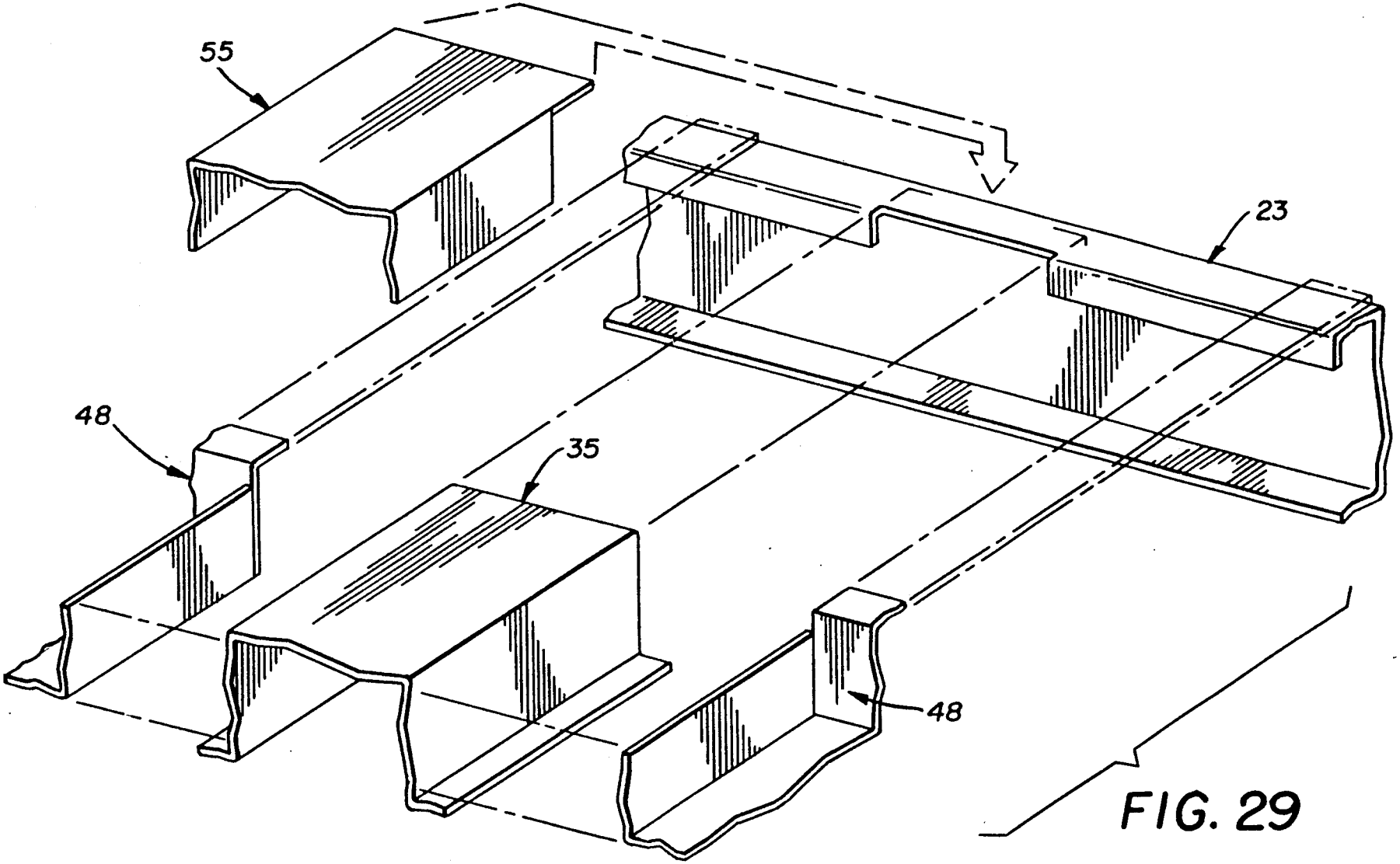
FIG. 29 is an exploded sectional view taken along the line 29—29 of FIG. 2.
Figure 30:
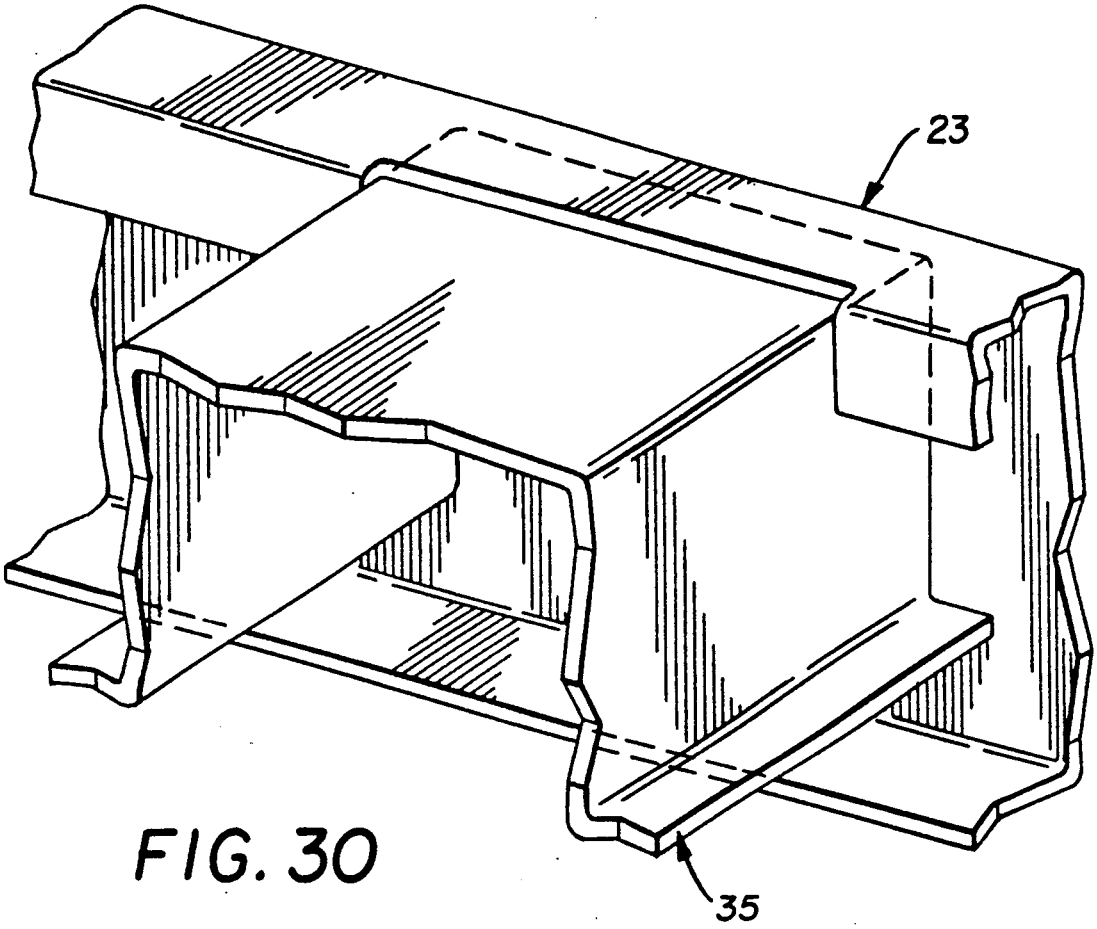
FIG. 30 is a perspective view showing the connection between the perimeter channel and the hat support; and, FIG. 31 is a sectional view taken along the line 31—31 of FIG. 2.
Figure 31:
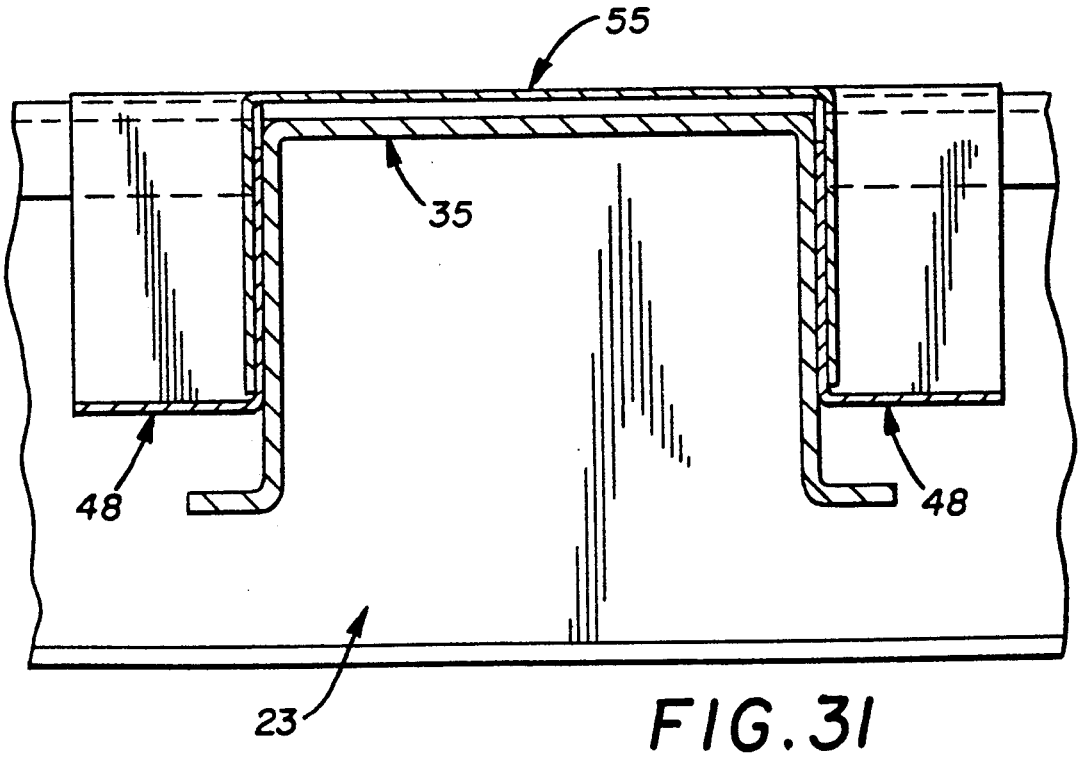

With some constructions it will be desirable to join the service building 10 with one or more lengths of a thermal break panel 294 schematically included within FIG. 28 and described in detail in U.S. Pat. No. 4,754,587. Such a connection can be readily effected by utilization of a transitional connector assembly 295, depicted in FIGS. 27 and 28, which includes a transitional connector mullion 296 (FIG. 27) and an interior support mullion 136 of the type previously described herein in conjunction with a corner post assembly 135, and as depicted in FIGS. 15. The transitional connector mullion 296 has a pair of connecting walls 298 and 299 which are disposed perpendicularly with respect to each other and which cooperate with the head 152 on the interior support mullion 136. Fasteners 76 may pass through a plurality of apertures 300 located along the locating grooves 301 and 302 provided on the obverse faces 303 and 304 of the connecting walls 298 and 299, respectively, to secure the transitional connector mullion 296 to the interior support mullion 136 employed in the corner post assembly 135 of the service building 10.

The transitional connector mullion 296 has an outside wall, or skirt, 305 which overlaps the facing surface 96 of the wall panel assembly 60D that is secured to the corner post assembly 135. The details by which the wall panel assemblies 60C and 60D are interconnected by virtue of the corner post assembly 135 were previously described herein with considerable specificity in conjunction with FIGS. 14–16 and need not, therefore, be repeated at this point.

An obliquely oriented first offset wall 306 may integrally connect the outside wall 305 to an exterior, first facing wall 308 which is, in turn, integrally connected to a second offset wall 309 that extends generally perpendicularly outwardly from the connecting wall 298. At the intersection of the connecting walls 298 and 299 a third offset wall 310 extends generally perpendicularly outwardly from the connecting wall 298 in substantial alignment with the connecting wall 299 to terminate in an exterior, second facing wall 311, the obverse face 312 of which may be coplanar with: the obverse face 313 on the exterior, first facing wall 308; the obverse, outer face 314 on the frame mullion strip 315 as well as the obverse, outer face 316 on the facing sheet 318 of the thermal connector panel 294. As such, the last two elements with which the obverse face 312 of the second facing wall 309 is coplanar are components of the thermal break panel 294 to which U.S. Pat. No. 4,754,587 is directed or any other panel of similar dimensional configuration.

A fourth offset wall 319 is integrally presented from the exterior, second facing wall 311 and extends generally perpendicularly therefrom in generally parallel relation with the third offset wall 310 to terminate in a first anchor flange 320, the purpose for which will be hereinafter more fully explained. A second anchor flange 321 extends outwardly from the connecting wall 299 in parallel, spaced relation from the first anchor flange 320, for purpose which will also be hereinafter more fully explained.

An extension wall 322 extends substantially perpendicularly outwardly from the proximal end portion of the second anchor flange 321. An abutting wall 323 extends substantially perpendicularly outwardly from the extension wall 322, and the distal end portion of the extension wall 322 presents an orienting flange 324 that is generally aligned with the extension wall 322 and disposed in substantially perpendicular relation with respect to the abutting wall 323. When the transitional connector mullion 296 is properly secured to the support mullion 136 the abutting wall 323 engages the side wall 68D on the skin member 62 of wall panel assembly 60C, and the orienting flange 324 engages the facing surface 96 of the wall panel assembly 60C. A third anchor flange 325 extends substantially outwardly from the second orienting wall 324 to lie in spaced, parallel relation with respect to the second anchor flange 321.

The representative thermal break panel 294 utilized in conjunction with the arrangements depicted in U.S. Pat. No. 4,754,587 has a standard frame member 326 along the edges of each panel 294. The frame member 326 has a web wall 328 with a first mullion strip 315 at the outer end of the web wall 328 and a second mullion strip 330 at the opposite end of the web wall 328. A pair of ribs 331 and 332 extend perpendicularly outwardly from the web wall 328 with the rib 331 located in spaced, parallel relation relative to the first frame mullion strip 315 to define a sealing cavity 333 between the first frame mullion strip 315 and the rib 331. Similarly, the rib 332 is located in spaced, parallel relation relative to the second frame mullion strip 330 to define a sealing cavity 334 between the second frame mullion strip 330 and the rib 332.

The thermal break panels 294 described in U.S. Pat. No. 4,754,587 are generally fabricated in two widths. The narrower of the thermal break panels is designated by the numeral 294 in FIG. 28. To effect an operative connection between the narrower panel 294 and the transitional connector mullion 296 the first anchor flange 320 is received within the sealing cavity 333 to lie in contiguous juxtaposition with respect to the first frame mullion strip 315. The first frame mullion strip 315, and the facing sheet 318 which cooperatively overlies a portion of the first frame mullion strip 315, may be secured to the first anchor flange 320 by virtue of a plurality of fateners 77 which penetrate the first frame mullion strip 315 (and preferably also the first facing sheet 318), the first anchor flange 320 and the rib 331 to secure those elements firmly together. The second anchor flange 321 is received within the sealing cavity 334 to lie in contiguous juxtaposition with respect to the second frame mullion strip 330. The second frame mullion strip 330, and the facing sheet 336 which cooperatively overlies a portion of the second mullion strip 330, may be secured to the second anchor flange 321 by virtue of a plurality of fasteners 77 which penetrate the second mullion strip 330 (and preferably also the facing sheet 335), the second anchor flange 321 and the rib 332 to secure those elements firmly together.

FIG. 27 also represents the location of a portion of what would be the thicker of the thermal break panels. Although the first frame mullion strip 315 is the same for either thickness, the portion of the thicker panel located at the innermost extent thereof is alphanumerically designated as 294A. To effect an operative connection between the thicker panel 294A and the transitional connector mullion 296 the first anchor flange 320 is received within the sealing cavity 333, and connected as previously described. The third anchor flange 325 is received within the sealing cavity 334A to lie in contiguous juxtaposition with respect to the second mullion strip 330A. The second mullion strip 330A, and the facing sheet 336A which cooperatively overlies a portion of the second mullion strip 330A, may be secured to the third anchor flange 325 by virtue of a plurality of fasteners 77A which penetrate the second mullion strip 330A (and preferably also the facing sheet 336), the third anchor flange 325 and the rib 332A to secure those elements firmly together.

It should now be apparent that the service building 10 can easily and quickly joined with a structure which takes advantage of the properties of the thermal break panel without the use of extraordinary tools or construction methods. Also the joining with the other structure does not affect the sealing integrity or the service building 10 inasmuch as the corner post assembly 135 remains effective to seal the interior of the service building 10 with the gaskets 74 which are disposed between the perimeter flanges 69 and the interior support mullion 136 in the same manner as in the corner post assembly 135 described with reference to FIG. 16.

The post and cover members, as well as the transitional connector mullion, may conveniently be fabricated by conventional extrusion processes. Generally these members will be made using aluminum to provide light weight and corrosion resistance to the general atmospheric conditions. As mentioned above the floor pans are constructed using materials or coatings that will be resistant to more corrosive substances that may come into contact with these pans. The wall and roof panels can also have various coatings or use construction materials that will withstand corrosive conditions.

The buildings constructed with the structural components described above can be used to house a wide variety of equipment. In general the service building 10 will usually enclose air moving and conditioning equipment such as fans, condensers, pumps and compressors. The insulation properties of the assemblies from which the service building 10 are fabricated will maintain the temperature environment within the service building 10 separate from that of the surrounding space, and will prevent the noise generated by the equipment within the service building 10 from affecting the surrounding areas.

The uniquely configured components described herein assure that a service building 10 embodying the concepts of the present invention cam be erected on-site without the need for sizing, or adjusting, the components on-site. Moreover, portions of the service building can be erected off-site and transported to the site pre-assembled, if desired. In fact, it will be noted that the use of the two-panel connecting mullion 166 and the third-panel connecting mullion 168 in the T-intersection post assembly 165 is particularly suited as a location for joining pre-assembled portions of the service building 10 on-site.

As should now be apparent, the present invention not only provides improved structural components from which a service building can be conveniently and efficiently fabricated but also accomplishes the other objects thereof.

I claim:

1. A building structure comprising:

a plurality of wall panel assemblies;

each said wall panel assembly having opposed skin members;

each said skin member having a central recess circumscribed by side walls which terminate in a peripheral flange portion;

the peripheral flange portions on said opposed skin members being secured together;

a base assembly;

said base assembly having a weight bearing support portion which extends around said building structure defining a perimeter and further defining a locus for a plurality of outer walls thereof;

a plurality of laterally spaced beam means spanning between, and supported from, that portion of the perimeter which defines one set of opposed, and spacially, separated, outer walls of the building structure;

said base assembly having a floor portion supported from said beam means and said perimeter support portion;

said floor portion including one or more decking sheets;

an insulating mat overlying at least some of said decking sheets;

a sump pan overlying said insulating mat;

a sill connector assembly to secure said wall panel assemblies to said base assembly; and, a plurality of post assemblies resting upon and extending upwardly from at least said sill connector assembly to secure successive wall panel assemblies together.

2. A building structure, as set forth in claim 1, wherein said wall panel assemblies further comprise:

a cavity defined by the central recesses in said opposed skin members; and, insulating means received within said cavity.

3. A building structure, as set forth in claim 2, wherein:

said peripheral flanges on said opposed skin members are secured together by a staking connection wherein metal from one peripheral flange is mechanically locked in engagement with the abutting peripheral flange on said opposed skin member;

said staking connections being spaced around the entire perimeter of each wall panel assembly firmly to retain the skin members together with said insulation received within said cavity.

4. A building structure, as set forth in claim 2, wherein:

a gasket means is secured to at least one side of said peripheral flange.

5. A building structure, as set forth in claim 1, wherein the perimeter support portion of said base assembly further comprises:

a plurality of side rails extending along the perimeter of said base assembly;

said side rails each having at least a lower ledge;

one or more decking sheets spanning between said side rails and resting upon said lower ledges;

said beam means overlying said decking sheets; and, said beam means being secured to said side rails and said decking sheets to support the latter.

6. A building structure, as set forth in claim 5, wherein:

a plurality of bays are defined by said laterally spaced beam means and a portion of said side rails extending therebetween; and, individual sump pans are supported from said beam means and said side rails to provide a liner for at least selected bays.

7. A building structure, as set forth in claim 6, wherein:

said deck sheeting is corrugated; and, said beam means being an open ended box beams having a hat shaped cross section.

8. A building structure, as set forth in claim 7, wherein:

said side rails also have an upper ledge;

said beam means are secured to said upper ledge on each side rail from which said beam means is supported;

said corrugated decking sheets have upper land surfaces; and, said beam means are also secured to said upper land surfaces on said corrugated decking sheets.

9. A building structure, as set forth in claim 1, further comprising:

frame members to circumscribe an aperture;

said frame members having a rectilinear body portion; and, a connecting flange extending outwardly from said rectilinear body portion for securing said frame members to selected post assemblies.

10. A building structure, as set forth in claim 1, wherein said sill connector assembly further comprises:

a sill connector member supported from, and secured to, said perimeter support portion;

a shelf-like abutting wall presented from said sill connector member to support a wall panel assembly;

a connecting wall presented from said sill connector member to which a length of said peripheral flange on the wall panel assembly resting on said shelf-like abutting wall can be secured; and, an inner wall on said sill connector member, said inner wall presenting an orienting flange to locate the wall panel assembly resting on said shelf-like abutting wall.

11. A building structure, as set forth in claim 10, wherein said sill connector assembly further comprises:

a sill cover plate;

said sill cover plate having a shoulder to rest upon said perimeter support portion of said base assembly;

a top wall to engage, and assist in the support of, said wall panel assembly resting on said shelf-like abutting wall; and, an outer wall.

12. A building structure as set forth in claim 11, wherein:

fastening means extend through said outer wall on said sill cover plate to secure said sill cover plate and said wall panel assembly resting on said shelf-like abutting wall to said connecting wall.

13. A building structure, as set forth in claim 12, wherein:

said connecting wall on said sill connector member has an outer and an inner surface;

an anchor rib extends longitudinally along said inner surface on said connecting wall; and, an locating groove extends longitudinally along said outer surface of said connecting wall to serve as an aligning guide which delineates the longitudinal center of said anchor rib.

14. A building structure, as set forth in claim 13, wherein:

a plurality of sealing grooves extend longitudinally along the outer surface of said connecting wall;

a gasket means is secured to said peripheral flange of said wall panel assembly resting upon said shelf-like abutting wall; and, said gasket engages said sealing grooves when said peripheral flange is secured to said connecting wall.

15. A building structure, as set forth in claim 14, wherein:

a lip is presented from said top wall on said sill cover plate; and, said lip engages said peripheral flange on said wall panel assembly resting on said shelf-like abutting wall to drive said gasket into sealing engagement with said sealing grooves on said connecting wall when said sill cover plate is secured to said sill connecting member.

16. A building structure, as set forth in claim 1, wherein said post assemblies further comprise:

a linear post assembly for joining successive, linearly oriented wall panel assemblies;

said linear post assembly having an interior support mullion and an exterior closure mullion;

said interior support mullion having a columnar support portion with a pair of associated, and opposed, abutting walls and connecting wall portions;

said abutting walls disposed to be engaged by side walls of the successive, linearly oriented wall panel assemblies conjoined by said linear post assembly;

said associated connecting wall portions disposed to lie in engaging juxtaposition with the peripheral flanges on said linearly oriented wall panel assemblies when they engage said abutting walls; and, fastener means to secure said peripheral flanges to said connecting wall portions.

17. A building structure, as set forth in claim 16, wherein:

said columnar support portion is of generally boxed, rectilinear cross section having a hollow interior;

an anchor rib extends longitudinally along each said connecting wall portion interiorly of said boxed, columnar support portion; and, a locating groove extends longitudinally along each said connecting wall portion exteriorly of said boxed columnar portion to serve as an aligning guide which delineates the longitudinal center of each said anchor rib.

18. A building structure, as set forth in claim 17, wherein:

a plurality of sealing grooves extend longitudinally of each said connecting wall portion;

a gasket means is secured to said peripheral flanges of said wall panel assemblies fastened to said interior support mullion;

said gasket means engages said sealing grooves when said peripheral flange is secured to said connecting wall portion.

19. A building structure, as set forth in claim 16, wherein said interior support mullion on said linear post assembly further comprises:

an extension wall extending outwardly from said columnar support portion between said opposed pairs of abutting walls and connecting wall portions;

said extension wall terminating in a head portion.

20. A building structure, as set forth in claim 19, wherein:

said exterior closure mullion has an outermost wall with lateral edges;

a pair of side wall extend substantially perpendicularly from the lateral edges of said outermost wall;

a pair of ribs, said ribs extending substantially perpendicularly from the medial portion of said outermost wall to embrace the head portion presented from said interior support mullion.

21. A building structure, as set forth in claim 20, wherein:

said side walls on said exterior closure mullion engage said side walls on said successively disposed, linearly aligned wall panel assemblies secured to said interior support mullion; and, fastener means secure said outermost wall to said head.

22. A building structure, as set forth in claim 21, wherein:

a locating groove extends longitudinally along said outermost wall of said closure mullion to identify the center of said head portion when said head portion is embraced by said ribs.

23. A building structure, as set forth in claim 22, wherein:

an engaging lip is presented from each said side wall of said closure mullion to engage the peripheral flange on the wall panel assemblies secured to said interior support mullion;

a gasket means is secured to at least one side of each peripheral flange presented from said wall panel assembly;

said engaging lips drive said gasket means on said peripheral flanges into sealing engagement with the connecting walls on said inner support mullion.

24. A building structure, as set forth in claim 16, wherein:

said columnar support portion is of generally boxed, rectilinear cross section with an innermost wall delineating one face thereof;

said connecting wall portions are aligned and define the connecting wall on said boxed support portion which is opposed to said innermost wall;

said abutting walls define the lateral sides of said boxed support portion;

an extension wall extends substantially perpendicularly outwardly from the medial portion of said connecting wall; and, said extension wall terminates in a head portion.

25. A building structure, as set forth in claim 24, wherein:

a web wall extends between said innermost wall and said connecting wall;

said web wall is preferably aligned with said extension wall; and, said head portion is preferably hollow.

26. A building structure, as set forth in claim 1, wherein said post assemblies further comprise:

a corner post assembly;

said corner post assembly having an interior support mullion and an exterior closure mullion;

said interior support mullion having a columnar support portion with a pair of associated abutting and connecting walls;

said abutting walls being preferably conjoined along a common edge and being oriented at right angles, one with respect to the other;

said connecting walls being oriented at right angles with respect to each other and being preferably conjoined not only with each other but also with the abutting walls;

said abutting walls being thus disposed to be engaged by side walls of the successive, perpendicularly disposed wall panel assemblies which converge at a corner of the building structure;

said connecting walls being thus disposed to be engaged by the peripheral flanges on said perpendicularly oriented wall panel assemblies when they engage said abutting walls; and, fastener means to secure said peripheral flanges to said connecting walls.

27. A building structure, as set forth in claim 26, wherein said interior support mullion on said corner post assembly further comprises:

an extension wall extending outwardly from the intersection of said connecting walls in substantial alignment with an imaginary diagonal passing between the intersection of said connecting walls and the opposed intersection of said abutting walls; and, said extension wall terminating in a head portion.

28. A building structure, as set forth in claim 27, wherein:

said columnar support portion is of generally boxed, rectilinear cross section having a hollow interior;

an anchor rib extends longitudinally along each said connecting wall interiorly of said boxed, columnar support portion; and, a locating groove extends longitudinally along each said connecting wall exteriorly of said boxed columnar portion to serve as an aligning guide which delineates the longitudinal center of each said anchor rib.

29. A building structure, as set forth in claim 28, wherein:

a plurality of sealing grooves extend longitudinally of each said connecting wall;

a gasket means is secured to said peripheral flanges of said wall panel assemblies fastened to said interior support mullion;

said gasket means engages said sealing grooves when said peripheral flange is secured to said connecting wall.

30. A building structure, as set forth in claim 29, wherein:

first and second orienting flanges are presented from said interior support mullion;

said first orienting flange extends at right angles with respect to said first abutting wall and is preferably aligned with said second abutting wall;

said second orienting flange extends at right angles with respect to said second abutting wall and is preferably aligned with said first abutting wall.

31. A building structure, as set forth in claim 27, wherein:

said exterior closure mullion has an outermost wall with lateral edges;

a pair of side wall extend obliquely from the lateral edges of said outermost wall; and, a pair of ribs extend substantially perpendicularly from the medial portion of said outermost wall to embrace said head portion presented from said interior support mullion.

32. A building structure, as set forth in claim 31, wherein:

said side walls on said exterior closure mullion engage said side walls on said successive, perpendicularly disposed, wall panel assemblies secured to said interior support mullion; and, fastener means to secure said outermost wall to said head portion.

33. A building structure, as set forth in claim 32, wherein:

a locating groove extends longitudinally along said outermost wall of said closure mullion to identify the center of said head portion when said head portion is embraced by said ribs.

34. A building structure, as set forth in claim 33, wherein:

said columnar support portion is of generally boxed, rectilinear cross section having a hollow interior;

an anchor rib extends longitudinally along each said connecting wall interiorly of said boxed, columnar support portion; and, a locating groove extends longitudinally along said connecting wall exteriorly of said boxed columnar portion to serve as an aligning guide which delineates the longitudinal center of said anchor rib.

35. A building structure, as set forth in claim 34, wherein:

a plurality of sealing grooves extend longitudinally said connecting walls;

a gasket means is secured to said peripheral flange of said wall panel assemblies fastened to said interior support mullion;

said gasket means engages said sealing grooves when said peripheral flange is secured to said connecting walls.

36. A building structure, as set forth in claim 1, wherein said post assemblies further comprise:

a T-intersection post assembly;

said T-intersection post assembly having a two panel connecting mullion, a third panel connecting mullion and an exterior closing mullion;

said two panel connecting mullion having a pair of associated abutting and connecting walls;

said abutting walls being preferably conjoined and being oriented at right angles, one with respect to the other;

said connecting walls also being oriented at right angles with respect to each other and being preferably conjoined;

a first joinder flange extending outwardly from the conjoined connecting walls on said two panel connecting mullion;

said first joinder flange being oriented in parallel relation with one said connecting wall and perpendicularly disposed with the other connecting wall on said two panel connecting mullion;

said abutting walls on said two panel connecting mullion being thus disposed to be engaged by side walls of the successive, perpendicularly disposed wall panel assemblies which converge at a T-intersection of the building structure;

said connecting walls on said two panel connecting mullion being disposed to be engaged by the peripheral flanges on said perpendicularly oriented wall panel assemblies when they engage said abutting walls on said two panel connecting mullion;

fastener means to secure said peripheral flanges to said connecting walls on said two panel connecting mullion;

said third panel connecting mullion having an abutting wall and a connecting wall disposed at right angles with respect to each other;

a second joinder flange extending substantially perpendicularly outwardly from said connector wall on said third panel connecting mullion;

said abutting wall on said third panel connecting mullion being thus disposed to be engaged by a side wall of the third wall panel assembly which converges at a T-intersection of the building structure;

said connecting wall on said third panel connecting mullion being disposed to be engaged by the peripheral flange on said wall panel assembly when it engages said abutting wall on said third panel connecting mullion;

fastener means to secure said peripheral flange to said connecting wall on said third panel connecting mullion; and, means to connect said first and second joinder flanges.

37. A building structure, as set forth in claim 36, wherein:

each said connecting wall has an obverse face and a reverse face;

an anchor rib extends longitudinally along the reverse face of each connecting wall;

a locating groove extends longitudinally along the obverse face of which said connecting wall to serve as an aligning guide which delineates the longitudinal center of each anchor rib.

38. A building structure, as set forth in claim 37, wherein:

a plurality of sealing grooves extend longitudinally along the obverse face of each connecting wall;

a gasket means is secured to said peripheral flanges of said wall panel assemblies fastened to said two panel connecting mullion and said third panel connecting mullion;

said gasket means engages said sealing grooves when said peripheral flanges are secured to said connecting walls.

39. A building structure, as set forth in claim 38, wherein:

first and second orienting flanges are presented both said two panel connecting mullion and said third panel connecting mullion;

said first orienting flange on said two panel connecting mullion extends at right angles with respect to one said abutting wall and said second orienting flange on said two panel connecting mullion is aligned with said same abutting wall;

said first orienting wall on said third panel connecting mullion extends at right angles with respect to said abutting wall thereon and said second orienting flange is aligned with said same abutting wall.

40. A building structure, as set forth in claim 39, wherein:

a return flange extends substantially perpendicularly with respect to said second joinder flange;

said exterior closure mullion has an outermost wall with lateral edges;

a pair of side wall extend substantially perpendicularly from the lateral edges of said outermost wall;

a pair of ribs, said ribs extending substantially perpendicularly from the medial portion of said outermost wall to embrace said return flange presented from said first joinder flange.

41. A building structure, as set forth in claim 40, wherein:

said side walls on said exterior closure mullion engage said side walls on said successively disposed, linearly aligned wall panel assemblies secured to said T-intersection post assembly; and, fastener means secure said outermost wall to said return flange.

42. A building structure, as set forth in claim 41, wherein:

a locating groove extends longitudinally along said outermost wall of said closure mullion to identify the center of said return flange when said return flange is embraced by said ribs.

43. A building structure, as set forth in claim 42, wherein:

an engaging lip is presented from each said side wall of said closure mullion to engage said opposed connecting walls of said T-intersection post assembly.

44. A building structure, as set forth in claim 1, further comprising:

a door jamb assembly circumscribing an opening;

a door panel assembly;

a perimeter mullion assembly circumscribing said door panel assembly; and, hinge means connecting said perimeter mullion assembly to said door jamb assembly.

45. A building structure, as set forth in claim 44, wherein said door jamb assembly further comprises:

a plurality of door frame supporting mullions;

said door frame supporting mullions presenting a connecting flange adapted to be secured to selected post assemblies; and, a door stop.

46. A building structure, as set forth in claim 45, wherein said door panel assembly further comprises:

opposed skin members;

said skin members having a central recess circumscribed by side walls which terminate in a peripheral flange;

the peripheral flanges on said opposed skin members being secured together.

47. A building structure, as set forth in claim 46, wherein said perimeter mullion assembly further comprises:

a connecting wall and an opposed compression head;

the peripheral flange on said door panel assembly received between said connecting wall and said compression head;

a hinge mounting flange;

a seal retaining cavity; and, a seal received within said cavity to be engaged by said door stop.

48. A building structure, as set forth in claim 1, further comprising:

frame members to circumscribe an aperture;

said frame members having a web wall and side flanges, said side flanges being laterally spaced to embrace the opposed skin members of said wall panel assembly.

49. A building structure, as set forth in claim 48, further comprising:

a pair of connecting flanges extending outwardly from said web wall in parallel relation to said side flanges; and, said connecting flanges defining a slot therebetween within which to receive the peripheral flange of a wall panel assembly.

50. A building structure, as set forth in claim 49, wherein:

one of said connecting flanges defines a recess within said slot.

51. A building structure, as set forth in claim 1, further comprising:

a transitional connector assembly to effect a connection with a thermal break panel;

an interior support mullion having a columnar support portion with a pair of associated abutting and connecting walls;

said abutting walls being preferably conjoined along a common edge and being oriented at right angles, one with respect to the other;

said connecting walls being oriented at right angles with respect to each other and being preferably conjoined not only with each other but also with the abutting walls;

said abutting walls being thus disposed to be engaged by side walls of the successive, perpendicularly disposed wall panel assemblies which converge at a corner of the building structure;

said connecting walls being thus disposed to be engaged by the peripheral flanges on said perpendicularly oriented wall panel assemblies when they engage said abutting walls;

fastener means to secure said peripheral flanges to said connecting walls;

an extension wall extending outwardly from the intersection of said connecting walls in substantial alignment with an imaginary diagonal passing between the intersection of said connecting walls and the opposed intersection of said abutting walls; and, said extension wall terminating in a head portion;

a transitional connector mullion;

connecting walls on said transitional connector mullion to engage said head portion on said interior support mullion;

fastener means to secure said connecting walls to said head portion;

at least two anchor flanges by which to effect a joinder to a thermal break panel.

* * * * *